US010569556B2

(12) United States Patent
Ishizawa et al.

(10) Patent No.: US 10,569,556 B2
(45) Date of Patent: Feb. 25, 2020

(54) INK REPLENISHMENT CONTAINER AND METHOD FOR MANUFACTURING INK REPLENISHMENT CONTAINER

(71) Applicant: SEIKO EPSON CORPORATION, Tokyo (JP)

(72) Inventors: Taku Ishizawa, Matsumoto (JP); Tadahiro Mizutani, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/053,372

(22) Filed: Aug. 2, 2018

(65) Prior Publication Data

US 2019/0039381 A1 Feb. 7, 2019

(30) Foreign Application Priority Data

Aug. 3, 2017 (JP) ..... 2017-150476

(51) Int. Cl.
*B41J 2/175* (2006.01)

(52) U.S. Cl.
CPC ..... *B41J 2/17506* (2013.01); *B41J 2/1755* (2013.01); *B41J 2/17509* (2013.01); *B41J 2/17513* (2013.01); *B41J 2/17523* (2013.01); *B41J 2/17533* (2013.01); *B41J 2/17553* (2013.01); *B41J 2/17559* (2013.01)

(58) Field of Classification Search
CPC ..... B41J 2/17509; B41J 2/17513; B41J 2/17523; B41J 2/17533; B41J 2/1755; B41J 2/17553; B41J 2/17559; B41J 2/17506
See application file for complete search history.

(56) References Cited

U.S. PATENT DOCUMENTS

| | | | | |
|---|---|---|---|---|
| 6,164,768 | A | 12/2000 | Murphy et al. | |
| 2009/0096836 | A1* | 4/2009 | Haines et al. | 347/49 |
| 2012/0198686 | A1 | 8/2012 | Kitagawa et al. | |

FOREIGN PATENT DOCUMENTS

| | | | |
|---|---|---|---|
| JP | 2001-146021 | A | 5/2001 |
| JP | 2003-305865 | A | 10/2003 |
| JP | 2004-009687 | A | 1/2004 |
| JP | 2012-161931 | A | 8/2012 |

* cited by examiner

*Primary Examiner* — Juanita D Jackson
(74) *Attorney, Agent, or Firm* — Foley & Lardner LLP

(57) ABSTRACT

Provided is a highly-convenient ink replenishment container. The ink replenishment container includes: a container main body portion capable of containing the ink; and an ink outlet forming portion that is to be attached to an end portion of the container main body portion and at which an ink outlet through which the ink flows out is formed. In a region located outside of the ink outlet, the ink replenishment container includes an erroneous insertion prevention portion that protrudes relative to the ink outlet in a direction opposite to the container main body portion in an axial direction as an axial center, and is configured to be inserted into a recessed portion and to prevent erroneous insertion into the ink tank. The erroneous insertion prevention portion includes protrusions that can be attached and detached, the protrusions are attached and detached in accordance with the shape of the recessed portion.

18 Claims, 28 Drawing Sheets

INK REPLENISHMENT CONTAINER AND METHOD FOR MANUFACTURING INK REPLENISHMENT CONTAINER

BACKGROUND

1. Technical Field

The present invention relates to an ink replenishment container and a method for manufacturing an ink replenishment container.

2. Related Art

Hereinbefore, an ink supply container that includes opposing tabs corresponding to a notch structure provided on an ink supply tank adapter has been known. This kind of ink supply container can be attached to only a predetermined ink supply tank adapter, and thus erroneous supply of ink can be prevented (e.g., see JP-A-2001-146021).

JP-A-2001-146021 is an example of related art.

However, in JP-A-2001-146021 above, it is necessary to form ink supply containers (or bottle caps) having multiple types of opposing tabs in correspondence with each of multiple ink supply tank adapters, and therefore the manufacturing cost is high.

Also, depending on the user, there are requests to use one ink supply container in common for multiple different printers, but if the forms of the ink supply tank adapters differ between the multiple printers, it is necessary to prepare ink supply containers for each printer (for each ink supply tank adapter), which is inconvenient.

SUMMARY

The invention has been made to solve this kind of problem, and an advantage of some aspects of the invention is to improve convenience for a user regarding an ink replenishment container and a method for manufacturing an ink replenishment container.

The invention can be implemented as the following modes or application examples.

Application Example 1

An ink replenishment container according to the present application example is an ink replenishment container capable of replenishing ink in an ink tank including an ink storage chamber with an interior in which the ink can be stored, an ink inlet through which the ink can flow into the interior of the ink storage chamber, and a recessed portion provided in the periphery of the ink inlet, the ink replenishment container including: a container main body portion capable of containing the ink; and an ink outlet forming portion that is to be attached to an end portion of the container main body portion and at which an ink outlet through which the ink in the container main body portion flows out is formed, wherein in a region located outside of the ink outlet in a radial direction centered about the ink outlet, the ink outlet forming portion includes an erroneous insertion prevention portion that protrudes relative to the ink outlet in a direction opposite to the container main body portion in an axial direction taking the center of the ink outlet as an axis, and that is configured to be inserted into the recessed portion of the ink tank and to prevent erroneous insertion into the ink tank, and the erroneous insertion prevention portion includes protrusions that can be attached and detached, and the protrusions are attached and detached in accordance with the shape of the recessed portion and are inserted into the recessed portion.

Since it is possible to attach and remove the protrusions of the erroneous insertion prevention portion in conformity with the shape of the recessed portion of the ink inlet, the molding apparatus or the like for the erroneous insertion prevention portion can be used in common (streamlined). Accordingly, it is possible to expect a reduction of manufacturing cost for the ink supply container.

Furthermore, depending on whether the protrusions of the erroneous insertion prevention portion are attached or removed (includes removing all of the protrusions), it is possible to perform insertion into ink tanks mounted on various printers, and it is possible to increase the versatility of the ink supply container.

Accordingly, the number of options for use methods of the ink supply container increase for the user, and thus convenience can be improved.

Application Example 2

In the ink replenishment container according to the above-described application example, if a plurality of the ink inlets are present and the shapes of the recessed portions of the ink inlets differ, the erroneous insertion prevention portion is inserted into each recessed portion with the protrusions attached or detached according to the shape of the recessed portion.

According to this configuration, the form of the erroneous insertion prevention portion can be flexibly changed according to the shape of the recessed portion of the ink inlet.

Application Example 3

In the ink replenishment container according to the above-described application example, a plurality of the erroneous insertion prevention portions are formed.

According to this configuration, multiple erroneous insertion prevention portions are present, and therefore erroneous insertion (erroneous attachment) into the ink tank can be reliably prevented.

Application Example 4

The erroneous insertion prevention portion of the ink replenishment container according to the above-described application example the erroneous insertion prevention portion includes a base portion that supports the protrusions, and notches are provided on end portions on the base portion side of the protrusions.

According to this configuration, the protrusions can be easily removed from the base portion using the notches as origins. Accordingly, an erroneous insertion prevention portion corresponding to the shape of the recessed portion of the ink inlet can be easily formed.

Application Example 5

In the erroneous insertion prevention portion of the ink replenishment container according to the above-described application example, the erroneous insertion prevention portion is disposed such that a first erroneous insertion prevention portion and a second erroneous insertion prevention portion oppose each other via the ink outlet, and the protrusions of the first erroneous insertion prevention portion and the second erroneous insertion prevention portion are attached and detached so as to be point-symmetrical with respect to the center of the ink outlet.

According to this configuration, the ink replenishment container can be attached to the ink tank even if it is rotated 180 degrees.

Application Example 6

In the ink replenishment container according to the above-described application example, all of the protrusions of the erroneous insertion prevention portion are removed.

According to this configuration, attachment to multiple types of ink tanks is possible, and an ink replenishment container of one form can be used in common.

Also, a case of using an ink replenishment container of a form in which protrusions are present from a state in which the protrusions are present, and a case of using an ink replenishment container of a form in which the protrusions are not present can be used as appropriate, whereby the convenience for the user can be increased.

Application Example 7

An ink replenishment container according to the present application example is an ink replenishment container capable of replenishing ink in an ink tank including an ink storage chamber with an interior in which the ink can be stored, an ink inlet through which the ink can flow into the interior of the ink storage chamber, and a recessed portion provided in the periphery of the ink inlet, the ink replenishment container including: a container main body portion capable of containing the ink; and an ink outlet forming portion that is to be attached to an end portion of the container main body portion and at which an ink outlet through which the ink in the container main body portion flows out is formed, wherein in a region located outside of the ink outlet in a radial direction centered about the ink outlet, the ink outlet forming portion includes an attachable and detachable erroneous insertion prevention portion configured to be inserted into the recessed portion of the ink tank and to prevent erroneous insertion into the ink tank.

According to this configuration, an erroneous insertion prevention portion corresponding to the shape of the recessed portion of the ink inlet is attached, and thereby a molding apparatus or the like for a member other than the erroneous insertion prevention portion can be used in common (streamlined). Accordingly, it is possible to expect a reduction of manufacturing cost for the ink supply container.

Furthermore, depending on whether the protrusions of the erroneous insertion prevention portion are attached or removed (includes a case in which the erroneous insertion prevention portion is not attached), it is possible to perform insertion into ink tanks mounted in various printers, and it is possible to increase the versatility of the ink supply container.

Accordingly, the number of options for use methods of the ink supply container increase for the user, and thus convenience can be improved.

Application Example 8

A method for manufacturing an ink replenishment container according to the present application example is a method for manufacturing an ink replenishment container capable of replenishing ink in an ink tank including an ink storage chamber with an interior in which the ink can be stored, an ink inlet through which the ink can flow into the interior of the ink storage chamber, and a recessed portion provided in the periphery of the ink inlet, the ink container including a container main body portion capable of containing the ink, and an ink outlet forming portion that is to be attached to an end portion of the container main body portion and at which an ink outlet through which the ink of the container main body portion flows out is formed, the ink outlet forming portion including an erroneous insertion prevention portion configured to be inserted into the recessed portion of the ink tank and to prevent erroneous insertion into the ink tank, wherein the erroneous insertion prevention portion of the ink outlet forming portion includes a first erroneous insertion prevention portion and a second erroneous insertion prevention portion, and predetermined protrusions among a plurality of protrusions formed on the first and second erroneous insertion prevention portions are removed.

According to this configuration, the first erroneous insertion prevention portion and the second erroneous insertion prevention portion are both present, and therefore it is possible to reliably prevent erroneous insertion (erroneous attachment) into the ink tank.

Also, after the multiple protrusions are first formed on the first and second erroneous insertion prevention portions, it is possible to remove the predetermined protrusions, and therefore the molding apparatus or the like for the first and second erroneous insertion prevention portions can be used in common (streamlined). Accordingly, it is possible to expect a decrease in the manufacturing cost.

Furthermore, depending on the removal of the protrusions of the first and second erroneous insertion prevention portions (e.g., includes removing all of the protrusions), it is possible to perform insertion into ink tanks mounted on various printers, and it is possible to increase the versatility of the ink replenishment container.

Accordingly, the number of options for use methods of the ink supply container increase for the user, and thus convenience can be improved.

Application Example 9

In the method for manufacturing an ink replenishment container according to the above-described application example, a base portion configured to support the plurality of protrusions is formed, and notches are provided on end portions on the base portion side of the protrusions.

According to this configuration, the protrusions can be easily removed from the base portion using the notches as origins. Accordingly, an erroneous insertion prevention portion can easily be formed corresponding to the shape of the recessed portion of the ink inlet.

Application Example 10

In the method for manufacturing an ink replenishment container according to the above-described application example, the first erroneous insertion prevention portion and the second erroneous insertion prevention portion are arranged so as to oppose each other via the ink outlet, and the first erroneous insertion prevention portion and the second erroneous insertion prevention portion are formed so as to be point-symmetrical with respect to the center of the ink outlet.

According to this configuration, even if the protrusions are removed, the first erroneous insertion prevention portion and the second erroneous insertion prevention portion can easily be formed point-symmetrically.

Application Example 11

In the method for manufacturing an ink replenishment container according to the above-described application example, the protrusions are removed such that the first erroneous insertion prevention portion and the second erroneous insertion prevention portion are point-symmetrical with respect to the center of the ink outlet.

According to this configuration, the ink replenishment container can be attached to the ink tank even if it is rotated 180 degrees.

Application Example 12

In the method for manufacturing an ink replenishment container according to the above-described application example, all of the plurality of protrusions formed on the first erroneous insertion prevention portion and the second erroneous insertion prevention portion are removed.

According to this configuration, attachment to multiple types of ink tanks is possible, and an ink replenishment container of one form can be used in common.

Also, a case of using an ink replenishment container of a form in which the protrusions are present, and a case of using an ink replenishment container of a form in which the protrusions are not present can be used as appropriate, whereby the convenience for the user can be increased.

Application Example 13

In the method for manufacturing an ink replenishment container according to the above-described application example, the protrusions are removed such that the first erroneous insertion prevention portion and the second erroneous insertion prevention portion are not point-symmetrical with respect to the center of the ink outlet.

According to this configuration, the number of form patterns of the erroneous insertion prevention portions can be further increased.

Application Example 14

In the method for manufacturing an ink replenishment container according to the above-described application example, the first erroneous insertion prevention portion that was formed or the second erroneous insertion prevention portion that was formed is removed.

According to this configuration, the first erroneous insertion prevention portion and the second erroneous insertion prevention portion are removed, and therefore attachment to a greater variety of ink tanks is possible, and the ink replenishment container of one form can be used in common.

Also, the case of using an ink replenishment container of a form in which the erroneous insertion prevention portions are present in a state in which the first erroneous insertion prevention portion and the second erroneous insertion prevention portion are present and a case of using an ink replenishment container of a form in which the erroneous insertion prevention portions are not present can be used as appropriate, and thereby the convenience for the user can be increased.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
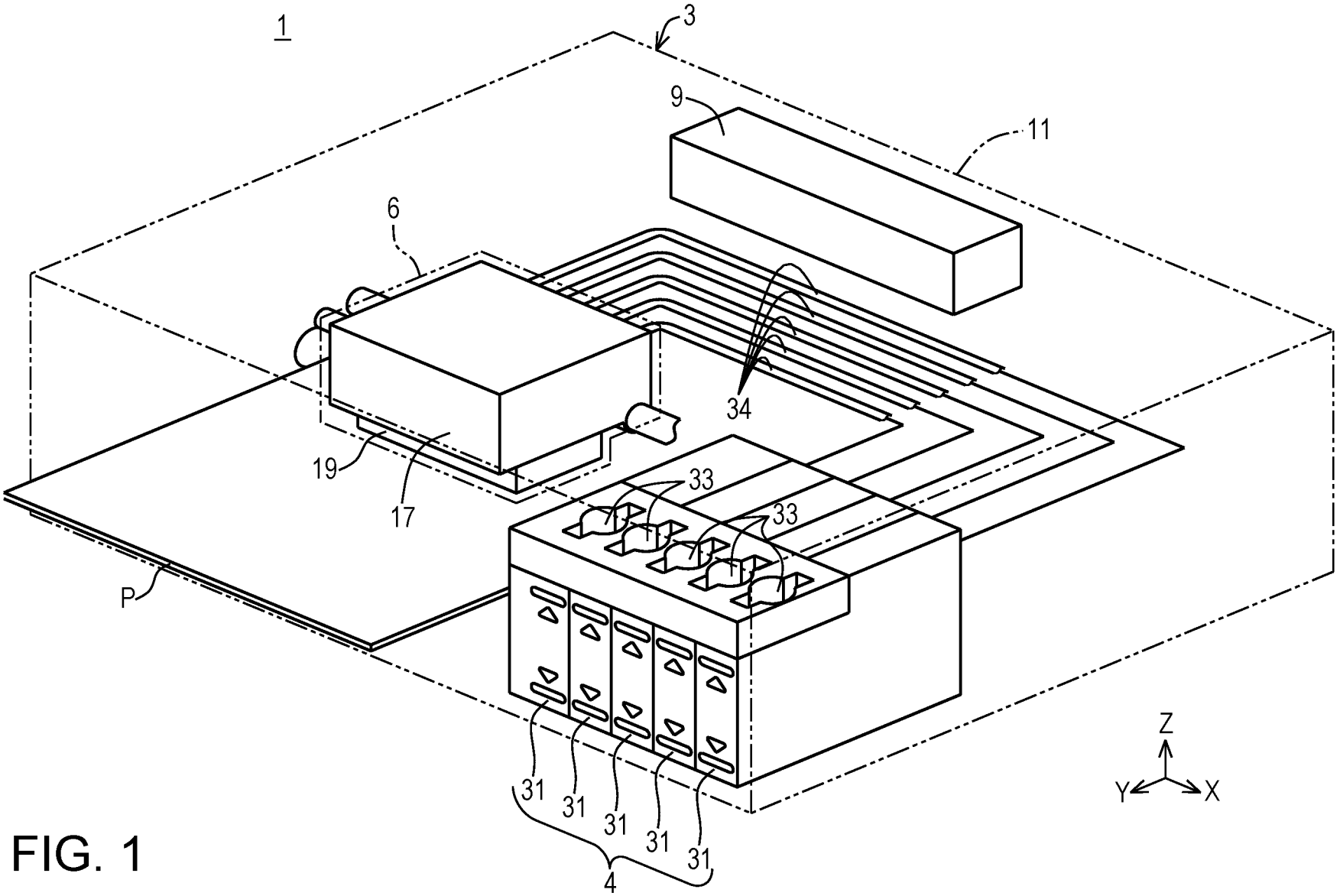
FIG. 1 is a perspective view schematically showing a main configuration of an ink ejection system according to a first embodiment.

Hereinafter, embodiments of the invention will be described with reference to the drawings. Note that in the drawings below, the members and the like are set to sizes at which they are recognizable, and therefore the scales of the members and the like differ from the actual scales in some cases.

First Embodiment

First, a configuration of an ink ejection system will be described. FIG. 1 is a perspective view schematically showing a main configuration of an ink ejection system.

As shown in FIG. 1, an ink ejection system 1 according to this embodiment includes an ink jet printer 3, which is an example of an ink ejection apparatus, and an ink supply apparatus 4. The printer 3 has a recorder 6 and a controller 9. Note that X, Y, and Z axes, which are orthogonal coordinate axes, are provided in FIG. 1. The X, Y, and Z axes are also provided as required in the subsequent drawings. In this case, the X, Y, and Z axes in each diagram correspond respectively to the X, Y, and Z axes in FIG. 1. FIG. 1 shows a state where the ink ejection system 1 is disposed on an XY plane defined by the X axis and the Y axis. In this embodiment, the state where the ink ejection system 1 is disposed on the XY plane with the XY plane being matched to a horizontal surface is a use state of the ink ejection system 1. The posture of the ink ejection system 1 when the ink ejection system 1 is disposed on the XY plane that is matched to a horizontal surface will be called a use posture of the ink ejection system 1.

Note that the horizontal surface need only be a surface that is substantially horizontal. For example, "substantially horizontal" encompasses tilting within an allowable tilting range with respect to the surface on which the ink ejection system 1 is mounted when used. Because of this, the substantially horizontal plane is not limited to a surface of a surface plate that is formed with high precision or the like, for example. For example, a substantially horizontal surface encompasses various surfaces, such as a desk, platform, shelf, or floor on which the ink ejection system 1 is mounted when used. Also, the vertical direction is not strictly limited to a direction along the gravity direction, and encompasses a direction that is orthogonal to the substantially horizontal surface. For this reason, when the substantially horizontal surface is a surface such as a desk, platform, shelf, or floor, "vertical direction" indicates the direction orthogonal to these surfaces.

Hereinafter, the X axis, Y axis, and Z axis that appear in the drawings and descriptions depicting constituent parts and units of the ink ejection system 1 mean the X axis, Y axis, and Z axis in a state where the constituent parts and units are assembled with (mounted in) the ink ejection system 1. The posture of the constituent parts and units when the ink ejection system 1 is in the use state will be called a use posture of these constituent parts and units. In the following description, the ink ejection system 1, the constituent parts and units thereof, and the like in their use posture will be described unless otherwise stated.

The Z axis is an axis perpendicular to the XY plane. When the ink ejection system 1 is in the use state, the Z axis direction is a vertically upward direction. Also, when the ink ejection system 1 is in the use state, the −Z axis direction is a vertically downward direction in FIG. 1. Note that, regarding the X, Y, and Z axes, the arrow orientation indicates a plus (positive) direction, and the orientation opposite to the arrow orientation indicates a minus (negative) direction. Note that "vertically upward direction" and "vertically upward" indicate the upward direction and upward along a vertical line. Similarly, "vertically downward direction" and "vertically downward" indicate the downward direction and downward along a vertical line. "Upward direction" and "upward", which are not described as vertical, are not limited to the upward direction and upward along a vertical line and encompass the upward direction and upward in a direction that intersects with a vertical line, excluding the horizontal direction. Also, "downward direction" and "downward", when not described as vertical, are not limited to the downward direction and downward along a vertical line and encompass a downward direction and downward in a direction that intersects with a vertical line, excluding the horizontal direction.

In the printer 3, the recorder 6 and the controller 9 are housed in a housing 11. The recorder 6 performs recording using ink, which is an example of a liquid, on a recording medium P, which is conveyed in the Y-axis direction by a conveying apparatus (not shown). Note that the conveying apparatus (not shown) intermittently conveys the recording medium P, such as recording paper, in the Y-axis direction. The recorder 6 is configured to be able to be moved back and forth along the X axis by a moving apparatus (not shown). An ink supply apparatus 4 supplies the ink to the recorder 6. The controller 9 controls driving of the aforementioned constituent parts.

Here, a direction parallel with the X axis is not limited to a direction that is perfectly parallel with the X axis, and also includes a direction that tilts relative to the X axis due to an error, a tolerance, or the like, excluding a direction perpendicular to the X axis. Similarly, a direction parallel with the Y axis is not limited to a direction that is perfectly parallel with the Y axis, and also includes a direction that tilts relative to the Y axis due to an error, a tolerance, or the like, excluding a direction perpendicular to the Y axis. A direction parallel with the Z axis is not limited to a direction that is perfectly parallel with the Z axis, and also includes a direction that tilts relative to the Z axis due to an error, a tolerance, or the like, excluding a direction perpendicular to the Z axis. That is to say, a direction parallel to an axis or a plane is not limited to a direction that is perfectly parallel with this axis or plane, and also includes a direction that tilts relative to this axis or plane due to an error, a tolerance, or the like, excluding a direction perpendicular to this axis or plane.

The recorder 6 includes a carriage 17 and a recording head 19. The recording head 19 is an example of an ink ejector, and discharges droplets of the ink to perform recording on the recording medium P. The recording head 19 is mounted in the carriage 17. Note that the recording head 19 is electrically connected to the controller 9. Discharge of ink droplets from the recording head 19 is controlled by the controller 9.

As shown in FIG. 1, the ink supply apparatus 4 includes ink tanks 31. In the present embodiment, the ink supply apparatus 4 includes multiple (in the present embodiment, five) ink tanks 31. The multiple ink tanks 3 are housed in the housing 11. That is, the multiple ink tanks 3 are housed in the housing 11 along with the recording head 19 and ink supply tubes 34. Accordingly, the ink tanks 31 can be protected by the housing 11. Note that it is also possible to employ a configuration in which the multiple ink tanks 31 are arranged outside of the housing 11. In this case, the ink supply apparatus 4 can be expressed as being separate from the printer 3.

The ink is contained in each ink tank 31. An ink injection portion 33 is formed in each ink tank 31. The ink can be injected into each ink tank 31 from outside via the ink injection portion 33. Note that an operator can access the ink injection portion 33 of the ink tank 31 from outside of the housing 11.

Ink supply tubes 34 are connected to the respective ink tanks 31. The ink in each ink tank 31 is supplied to the recording head 19 from the ink supply apparatus 4 via the corresponding ink supply tube 34. The ink supplied to the recording head 19 is discharged as ink droplets from nozzles (not shown), which are oriented toward the recording medium P side. Also, the ink supplied to the recording head 19 is discharged as ink droplets from nozzles (not shown) provided on the recording medium P side. Note that in the above-described example, the printer 3 and the ink supply apparatus 4 are described as an integral configuration, but the ink supply apparatus 4 and the printer 3 may be separate configurations.

In the ink ejection system 1 having the above configuration, recording is performed onto the recording medium P by conveying the recording medium P in the Y-axis direction, and causing the recording head 19 to discharge ink droplets at a given position while moving the carriage 17 back and forth along the X axis. This operation is controlled by the controller 9.

The ink is not limited to either one of water-based ink or oil-based ink. Water-based ink may be either ink having a configuration in which a solute, such as a dye, is dissolved in a water-based solvent, or ink having a configuration in which a dispersoid, such as a pigment, is dispersed in a water-based dispersing medium. Oil-based ink may be either ink having a configuration in which a solute, such as a dye, is dissolved in an oil-based solvent, or ink having a configuration in which a dispersoid, such as a pigment, is dispersed in an oil-based dispersing medium.

Figure 2:
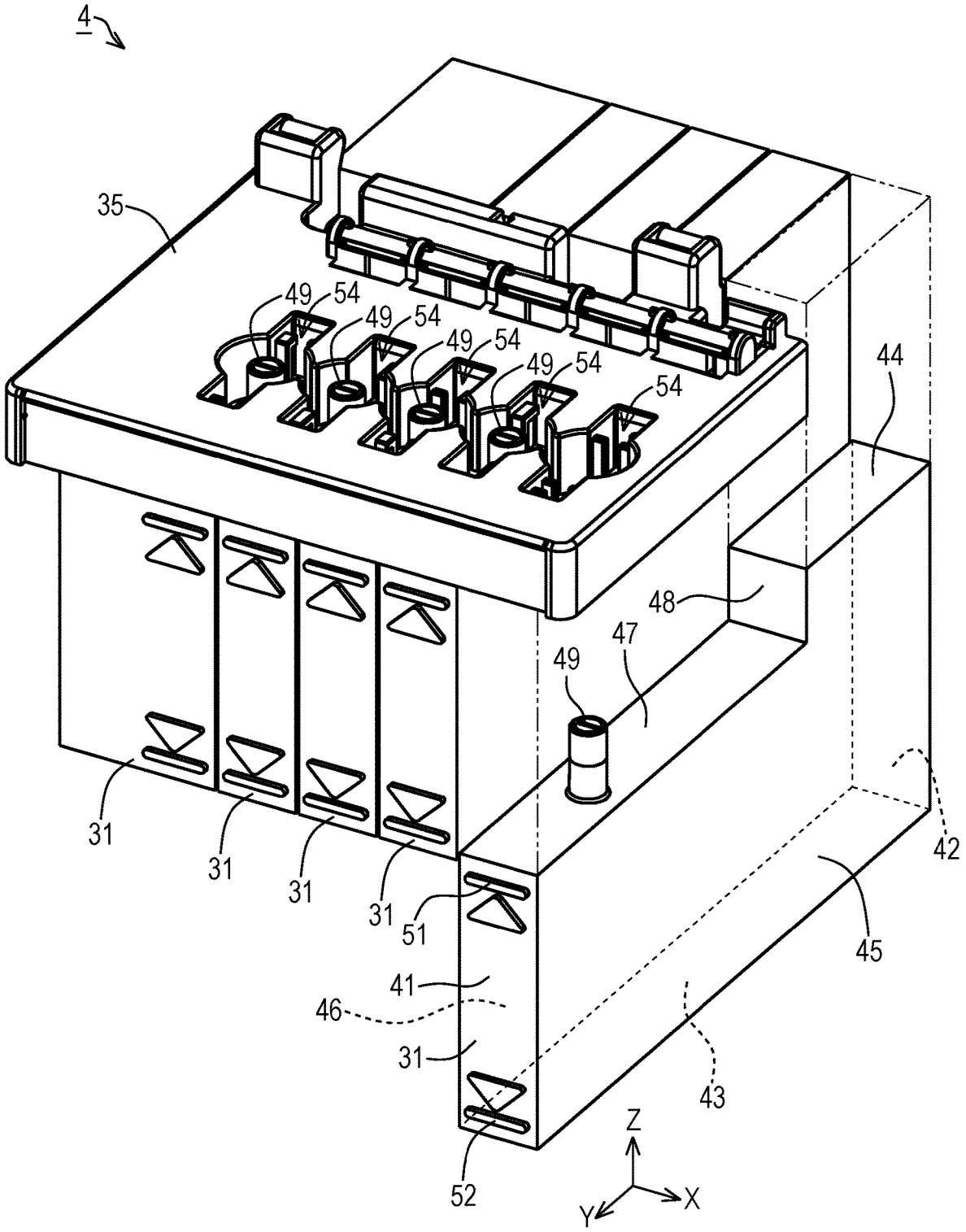
FIG. 2 is an exploded perspective view showing a main configuration of an ink supply apparatus according to the first embodiment.

FIG. 2 is an exploded perspective view showing a main configuration of an ink supply apparatus. As shown in FIG. 2, the ink supply apparatus 4 includes the multiple ink tanks 31 and an adapter 35. The multiple ink tanks 31 are arranged side-by-side along the X axis and have the same configurations and shapes as each other. In the ink supply apparatus 4, the multiple ink tanks 31 are integrally bundled by the adapter 35. In FIG. 2, in order to show the configuration in a manner that is easy to understand, a state is shown in which one of the multiple ink tanks 31 is removed from the adapter 35.

In the present embodiment, it is possible to employ a configuration in which inks of types that are different from each other are contained in the respective ink tanks 31 or a configuration in which inks of types that are the same as each other are contained in the respective multiple ink tanks 31. Examples of types of ink include the color of the ink. Accordingly, in the present embodiment, it is possible to employ a configuration in which inks of colors that are different from each other are contained in the respective ink tanks 31 or a configuration in which inks of colors that are the same as each other are contained in the respective multiple ink tanks 31. Examples of the colors of the ink include black, yellow, magenta, and cyan.

The length dimension along the Y axis of each ink tank 31 is larger than the width dimension along the X axis of each ink tank 31. Also, the height dimension along the Z axis of each ink tank 31 is smaller than the length dimension along the Y axis of each ink tank 31. However, the dimensions of the ink tanks 31 are not limited thereto, and various dimensions can be employed. Each ink tank 31 includes a first wall 41, a second wall 42, a third wall 43, a fourth wall 44, a fifth wall 45, a sixth wall 46, a seventh wall 47, and an eighth wall 48. Also, each ink tank 31 includes a connection pipe 49 (ink inlet). The first wall 41 to the eighth wall 48 constitute an outer shell (ink storage chamber) of the ink tank 31. The number of walls constituting the outer shell of the ink tank 31 is not limited to eight, namely the first wall 41 to the eighth wall 48, and it is also possible to employ a number less than eight or a number greater than eight.

The first wall 41 faces the Y axis direction and extends along the XZ plane. The first wall 41 is optically transmissive and is configured such that the ink inside of the ink tank 31 can be viewed via the first wall 41. That is, the first wall 41 is a viewing wall through which the amount of ink inside of the ink tank 31 can be viewed. An upper limit mark 51 and a lower limit mark 52 are provided on the first wall 41. An operator can keep track of the amount of ink in the ink tank 31 by using the upper mark 51 and the lower mark 52 as signs or guides.

Note that the markers for reporting the amount of ink in the ink tank 31 are not limited to the upper limit mark 51 and the lower limit mark 52, and tick marks indicating amounts of ink or the like can also be employed. It is also possible to employ a configuration in which tick marks are added to the upper limit mark 51 and the lower limit mark 52, a configuration in which the upper limit mark 51 and the lower limit mark 52 are omitted and only the notches are added, or the like. It is also possible to employ markers indicating the types of ink contained in the ink tanks 31 as the markers added to the ink tanks 31. Examples of the markers include markers indicating the color of the ink as the type of the ink. Examples of markers indicating the color of the ink include various markers, such as display using letters such as "Bk", which indicates black ink, "C", which indicates cyan ink, "M", which indicates magenta ink, and "Y", which indicates yellow ink, or display using colors.

The second wall 42 opposes the first wall 41 and faces the −Y axis direction. The second wall 42 extends along the XZ plane. The third wall 43 intersects the first wall 41 and the second wall 42. Note that two surfaces intersecting indicates that the two surfaces are in a positional relationship of not being parallel to each other. Other than the case in which the two surfaces are in direct contact with each other, in the case of a relationship in which the extension of one surface and the extension of the other surface intersect even if they are in a positional relationship of not being in direct contact and being separated from each other, the two surfaces can also be expressed as intersecting. The angle formed by the two intersecting surfaces may be a right angle, an obtuse angle, or an acute angle.

The third wall 43 intersects the first wall 41 and the second wall 42. The third wall 43 is located in the −Z axis direction of the first wall 41 and the second wall 42 and faces the −Z axis direction. The third wall 43 extends along the XY plane. The end portion in the Y axis direction of the third wall 43 is connected to the end portion in the −Z axis direction of the first wall 41. Also, the end portion in the −Y axis direction of the third wall 43 is connected to the end portion in the −Z axis direction of the second wall 42.

The fourth wall 44 opposes the third wall 43 and faces the Z axis direction. The fourth wall 44 intersects the second wall 42 and extends along the XY plane. The fourth wall 44 is located in the Z axis direction of the second wall 42. The fourth wall 44 is located in the −Y axis direction with respect to the first wall 41. Also, the end portion in the −Y axis direction of the fourth wall 44 is connected to the end portion in the Z axis direction of the second wall 42.

The fifth wall 45 intersects the first wall 41, the second wall 42, the third wall 43, and the fourth wall 44. The fifth wall 45 is located in the X axis direction of the first wall 41, the second wall 42, the third wall 43, and the fourth wall 44. The fifth wall 45 faces the X axis direction and extends along the YZ plane. The end portion in the Y axis direction of the fifth wall 45 is connected to the end portion in the X axis direction of the first wall 41. The end portion in the −Y axis direction of the fifth wall 45 is connected to the end portion in the X axis direction of the second wall 42. The end portion in the −Z axis direction of the fifth wall 45 is connected to the end portion in the X axis direction of the third wall 43. The end portion in the Z axis direction of the fifth wall 45 is connected to the end portion in the X axis direction of the fourth wall 44.

The sixth wall 46 intersects the first wall 41, the second wall 42, the third wall 43, and the fourth wall 44. The sixth wall 46 is located in the −X axis direction of the first wall 41, the second wall 42, the third wall 43, and the fourth wall 44 and opposes the fifth wall 45. The sixth wall 46 faces the −X axis direction and extends along the YZ plane. The end portion in the Y axis direction of the sixth wall 46 is connected to the end portion in the −X axis direction of the first wall 41. The end portion in the −Y axis direction of the sixth wall 46 is connected to the end portion in the −X axis direction of the second wall 42. The end portion in the −Z axis direction of the sixth wall 46 is connected to the end portion in the −X axis direction of the third wall 43. The end portion in the Z axis direction of the sixth wall 46 is connected to the end portion in the −X axis direction of the fourth wall 44.

The seventh wall 47 is located in the Z axis direction of the first wall 41 and intersects the first wall 41. The seventh wall 47 faces the Z axis direction and extends along the XY plane. The seventh wall 47 is located between the third wall 43 and the fourth wall 44. The end portion in the Y axis direction of the seventh wall 47 is connected to the end portion in the Z axis direction of the first wall 41. In other words, the ink tank 31 includes a level difference between the fourth wall 44 and the seventh wall 47. The end portion in the −X axis direction of the seventh wall 47 is connected to the fifth wall 45. The end portion in the X axis direction of the seventh wall 47 is connected to the sixth wall 46.

The eighth wall 48 is located in the −Y axis direction of the seventh wall 47 and faces the Y axis direction. Also, the eighth wall 48 is located in the Y axis direction of the fourth wall 44. The eighth wall 48 extends along the XZ plane. The end portion in the −Z direction of the eighth wall 48 is connected to the end portion in the −Y direction of the seventh wall 47, and the end portion in the Z direction of the eighth wall 48 is connected to the end portion in the Y direction of the fourth wall 44. In other words, in the ink tank 31, the level difference between the fourth wall 44 and the seventh wall 47 is connected via the eighth wall 48.

The surface of the seventh wall 47 facing the Z axis direction is provided with the connection pipe 49, which is an example of a connection portion. The connection pipe 49 extends toward the Z axis direction from the seventh wall 47. The connection pipe 49 is formed into a hollow pipe shape and extends in the Z axis direction. Based on this configuration, the connection pipe 49 can be expressed as being chimney-shaped. The connection pipe 49 communicates with the interior of the ink tank 31. The ink injected into the ink tank 31 is injected into the ink tank 31 via the connection pipe 49.

Figure 3:
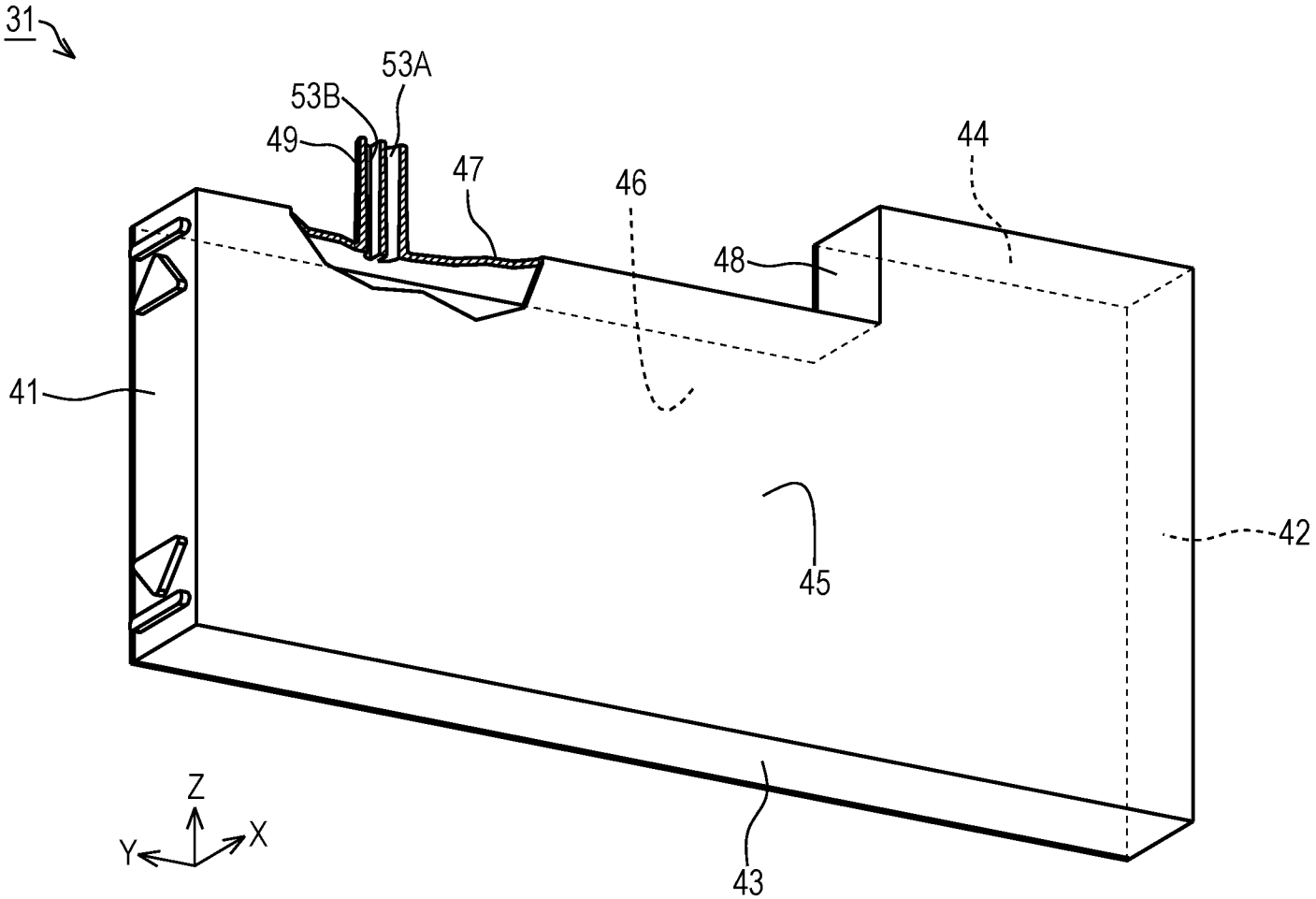
FIG. 3 is a perspective view showing an ink tank according to the first embodiment.

FIG. 3 is a perspective view showing an ink tank. As shown in FIG. 3, the interior of the connection pipe 49 is divided into two flow paths, namely a flow path 53A and a flow path 53B, along the Z axis. The flow path 53A and the flow path 53B communicate with the interior of the ink tank 31. In FIG. 3, in order to show the interior of the connection pipe 49 in a manner that is easy to understand, a state is shown in which a portion of the ink tank 31 including the connection pipe 49 has been broken off.

As shown in FIG. 2, the adapter 35 has a dimension that spans over the multiple ink tanks 31 arranged side-by-side along the X axis. The adapter 35 is located in the Z axis direction of the seventh wall 47 of the ink tank 31. Multiple slot portions 54 (recessed portions) are formed in the adapter 35. The adapter 35 is provided with slot portions 54 in correspondence with the respective multiple ink tanks 31 arranged side-by-side along the X axis. Note that the number of slot portions 54 may be greater than the number of the multiple ink tanks 31 arranged side-by-side along the X axis.

The slot portions 54 are formed in an orientation of being recessed in the −Z axis direction from the upper surface of the adapter 35 in the Z axis direction. A later-described through hole 55 is formed in the bottom of each slot portion 54. The through hole 55 penetrates through the adapter 35 along the Z axis. The through hole 55 has a size according to which the connection pipe 49 of the ink tank 31 can be inserted. The adapter 35 is attached at the level difference portion between the fourth walls 44 and the seventh walls 47 of the ink tanks 31. Also, when the adapter 35 is attached to the ink tanks 31, in the ink supply apparatus 4, the connection pipes 49 of the ink tanks 31 are inserted into the slot portions 54 via the through holes 55 of the adapter 35. Accordingly, when the adapter 35 is attached to the ink tanks 31, the connection pipes 49 of the ink tanks 31 are exposed via the slot portions 54 of the adapter 35. Note that the ink injection portions 33 shown in FIG. 1 are collective terms for the slot portions 54 of the adapter 35 and the configurations inside of the slot portions 54 (includes the connection pipes 49) when the adapter 35 is attached to the ink tank 31.

Figure 4:
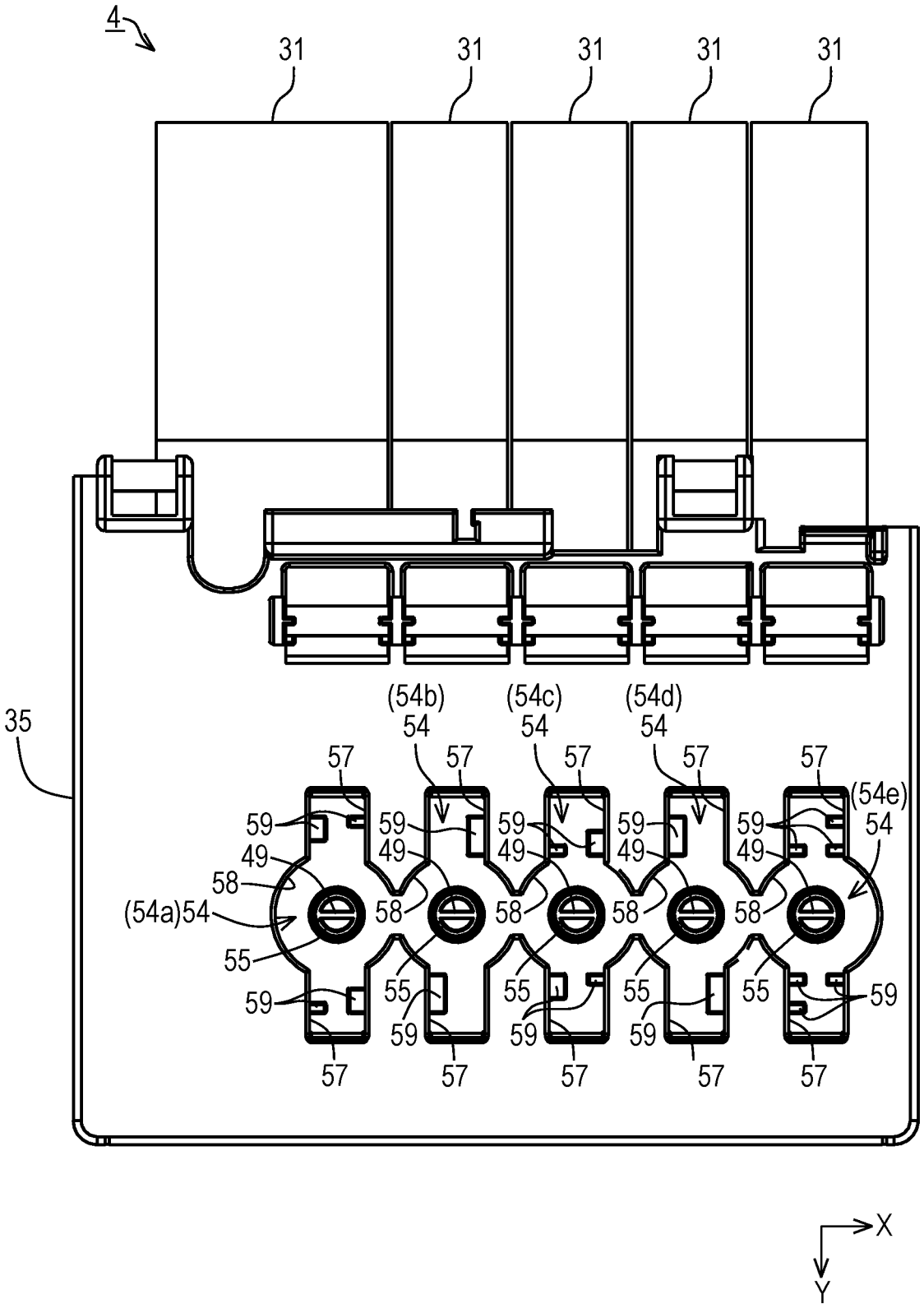
FIG. 4 is a plan view showing the ink tank and an adapter according to the first embodiment.

FIG. 4 is a plan view showing ink tanks and an adapter. As shown in FIG. 4, each slot portion 54 has an exterior obtained by overlaying a rectangular rectangle portion 57 that extends along the Y axis and a circular circle portion 58 located in the center along the Y axis of the rectangle portion 57. The through hole 55 is formed at the bottom of the circle portion 58. Note that in the present embodiment, the circle portions 58 of two adjacent slot portions 54 are connected to each other along the X axis. The connection pipes 49 of the ink tanks 31 are arranged at positions overlapping the through holes 55 of the circle portions 58.

First protruding portions 59 are provided on inner walls of the rectangle portion 57 that extends along the YZ plane. In each slot portion 54, the first protruding portions 59 are provided on the rectangle portions 57 that oppose each other on opposite sides of the circle portion 58. In one slot portion 54, the first protruding portions 59 are disposed point-symmetrically with respect to the central point of the connection pipe 49. According to the above-described configuration, the slot portion 54 has a structure that is point-symmetrical with respect to the central portion of the connection pipe 49. In the multiple slot portions 54 provided in the adapter 35, the configurations of the first protruding portions 59 differ from each other. For this reason, the multiple slot portions 54 formed in the adapter 35 have structures that differ from each other.

In contrast to this, in later-described ink bottles 62 (ink replenishment containers), erroneous insertion prevention portions 120 corresponding to first protruding portions 59 of the slot portions 54 into which they can fit are provided according to the types of the multiple slot portions 54 provided in the adapter 35. Accordingly, the types of the ink bottles 62 that can fit into the respective multiple slot portions 54 provided in the adapter 35 can be restricted. That is, the multiple slot portions 54 provided in the adapter 35 can be expressed as functioning as keyholes that have structures that differ from each other. Also, the ink bottles 62 that can fit into the respective multiple slot portions 54 provided in the adapter 35 can be expressed as functioning as keys that fit into the keyholes. That is, ink can be injected into the ink tanks 31 via the connection pipes 49 from the ink bottles 62 that fit into the keyholes. Conversely, ink cannot be injected into the ink tanks 31 with ink bottles 62 that do not fit into the keyholes.

Figure 5:
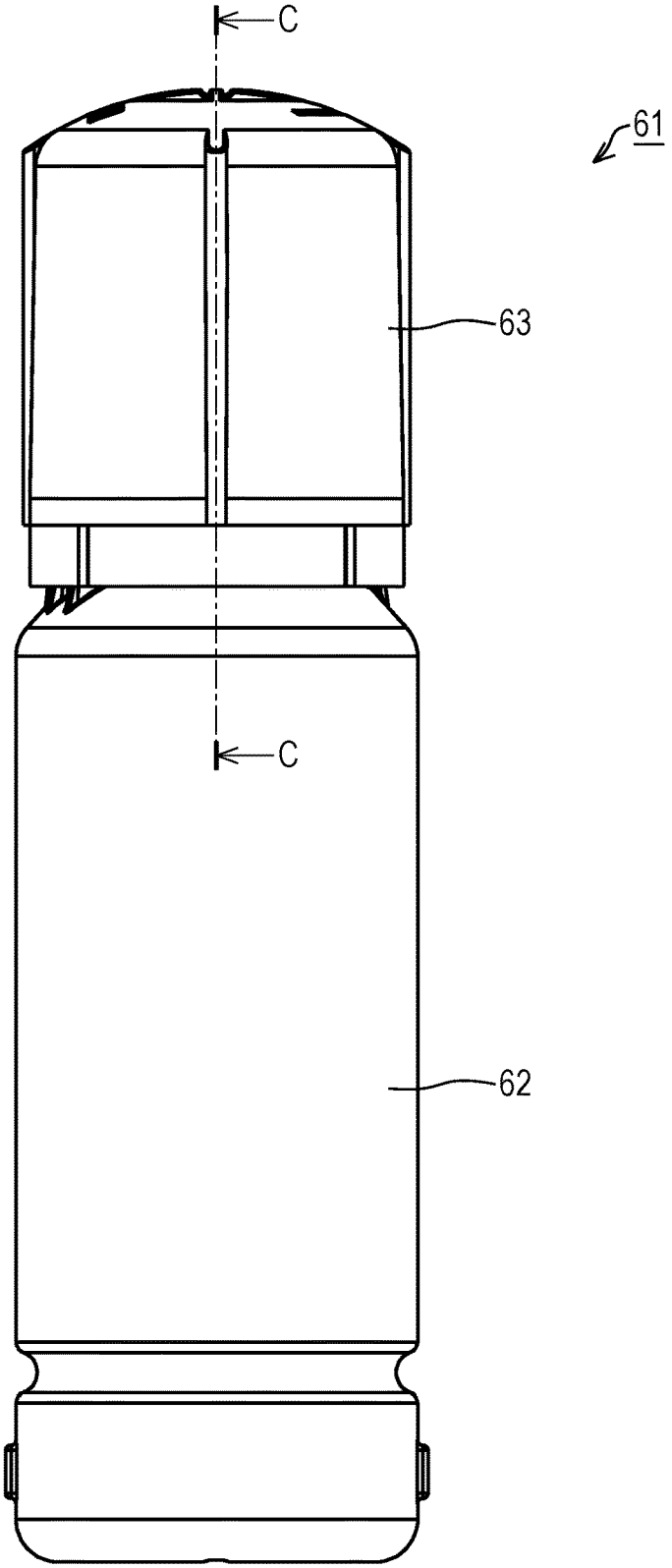
FIG. 5 is an external view showing a bottle set according to the first embodiment.
Figure 6:
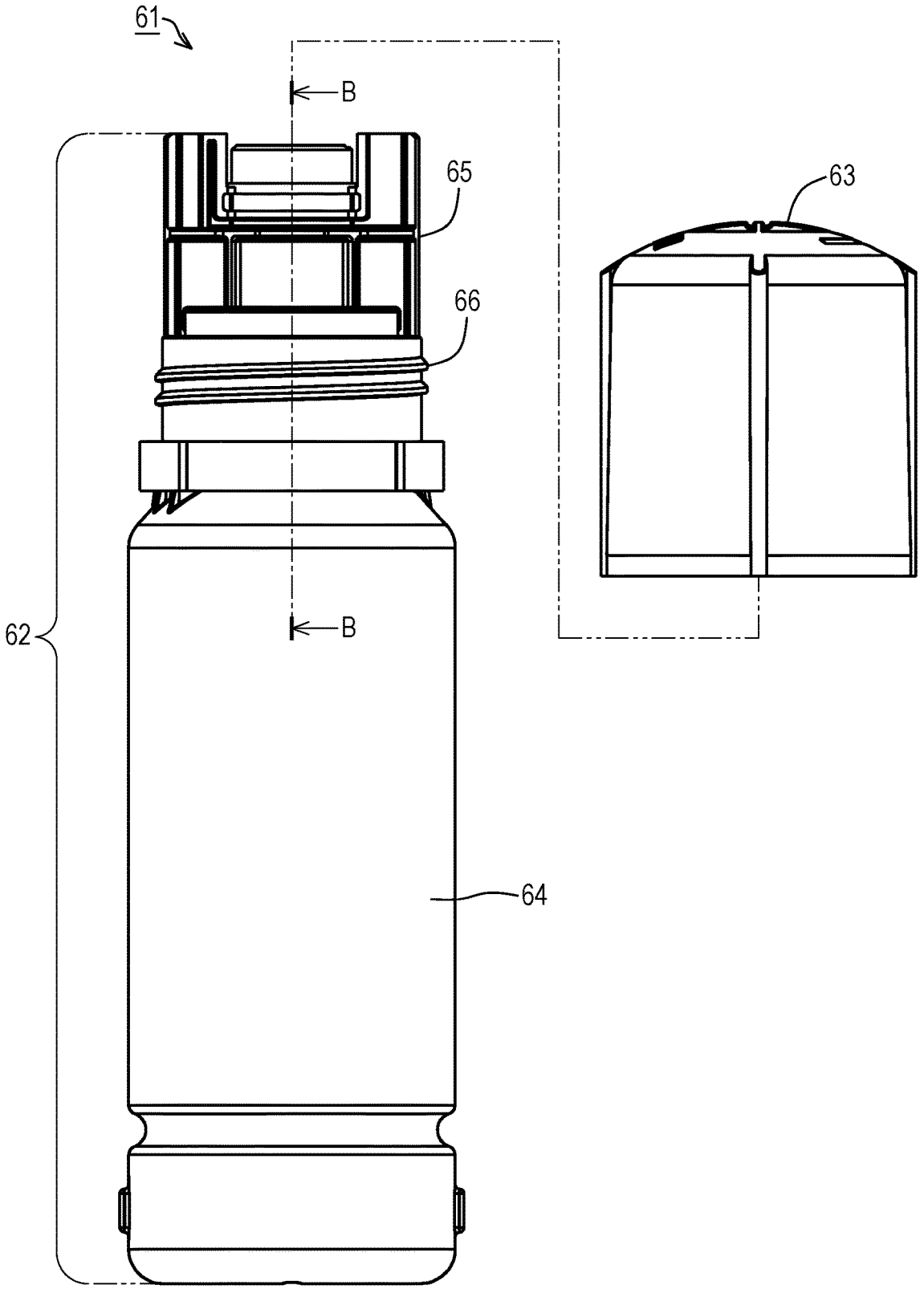
FIG. 6 is an exploded view showing the bottle set according to the first embodiment.
Figure 7:
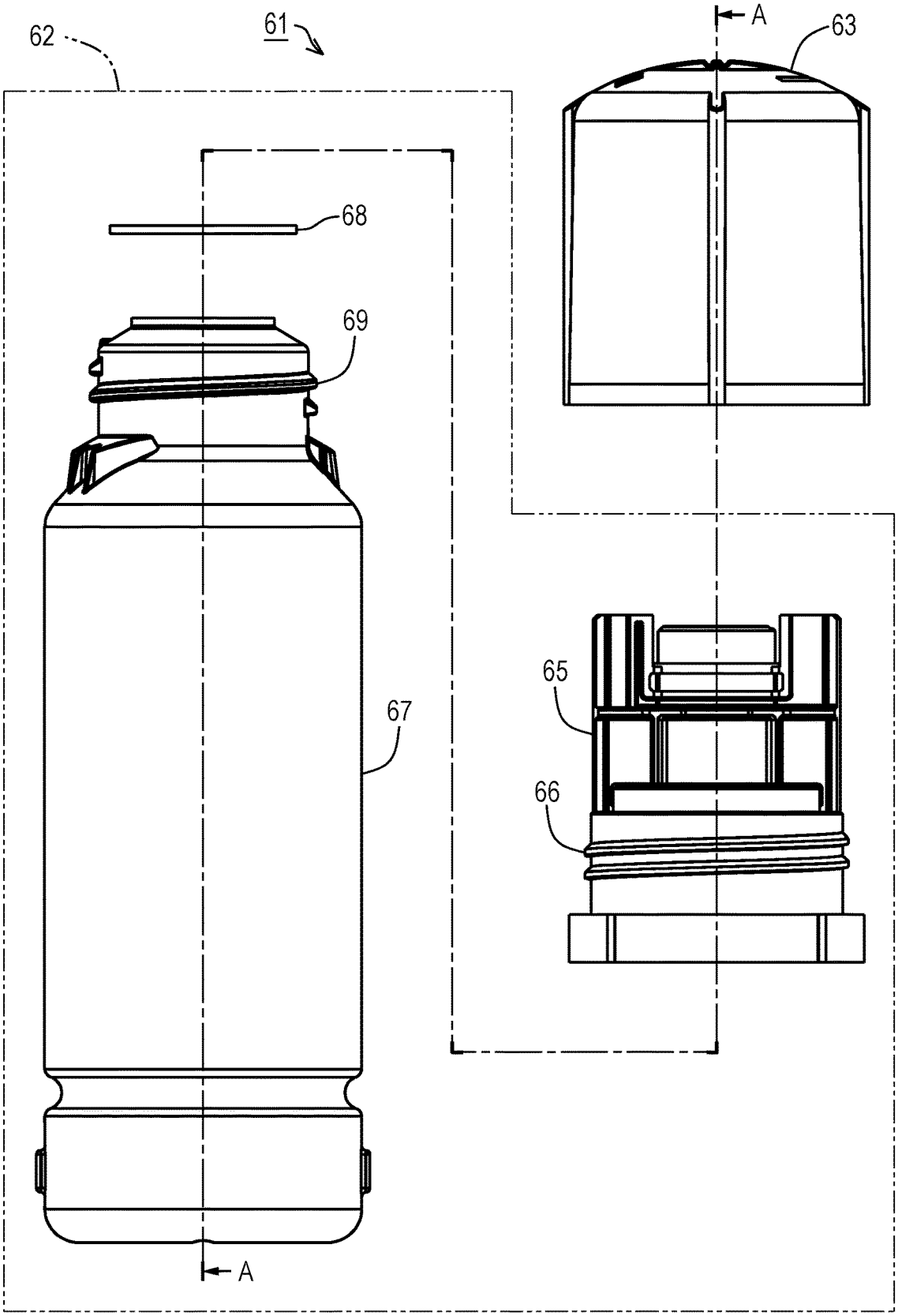
FIG. 7 is an exploded view showing the bottle set according to the first embodiment.
Figure 8:
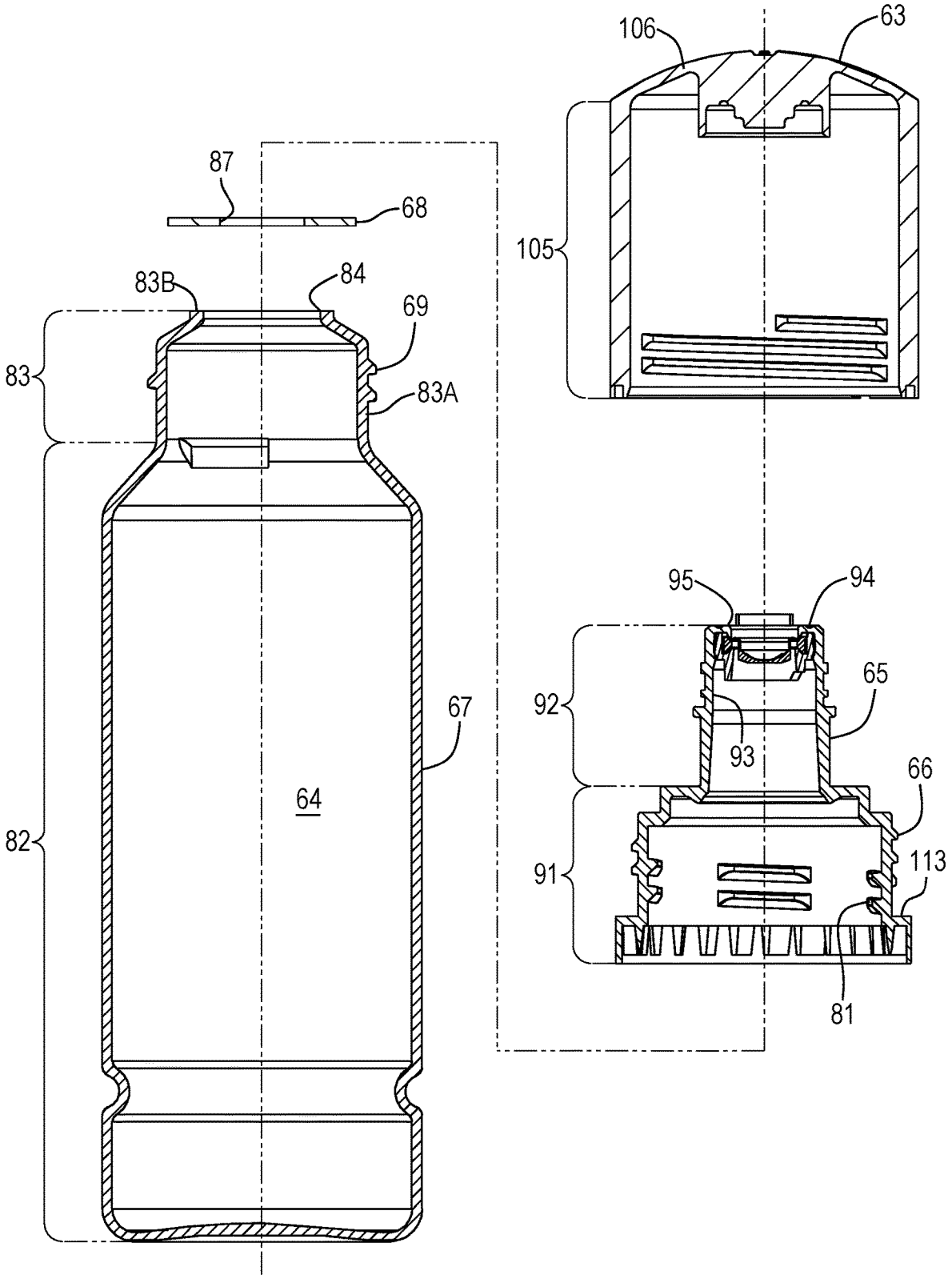
FIG. 8 is a cross-sectional view taken along line A-A in FIG. 7.
Figure 9:
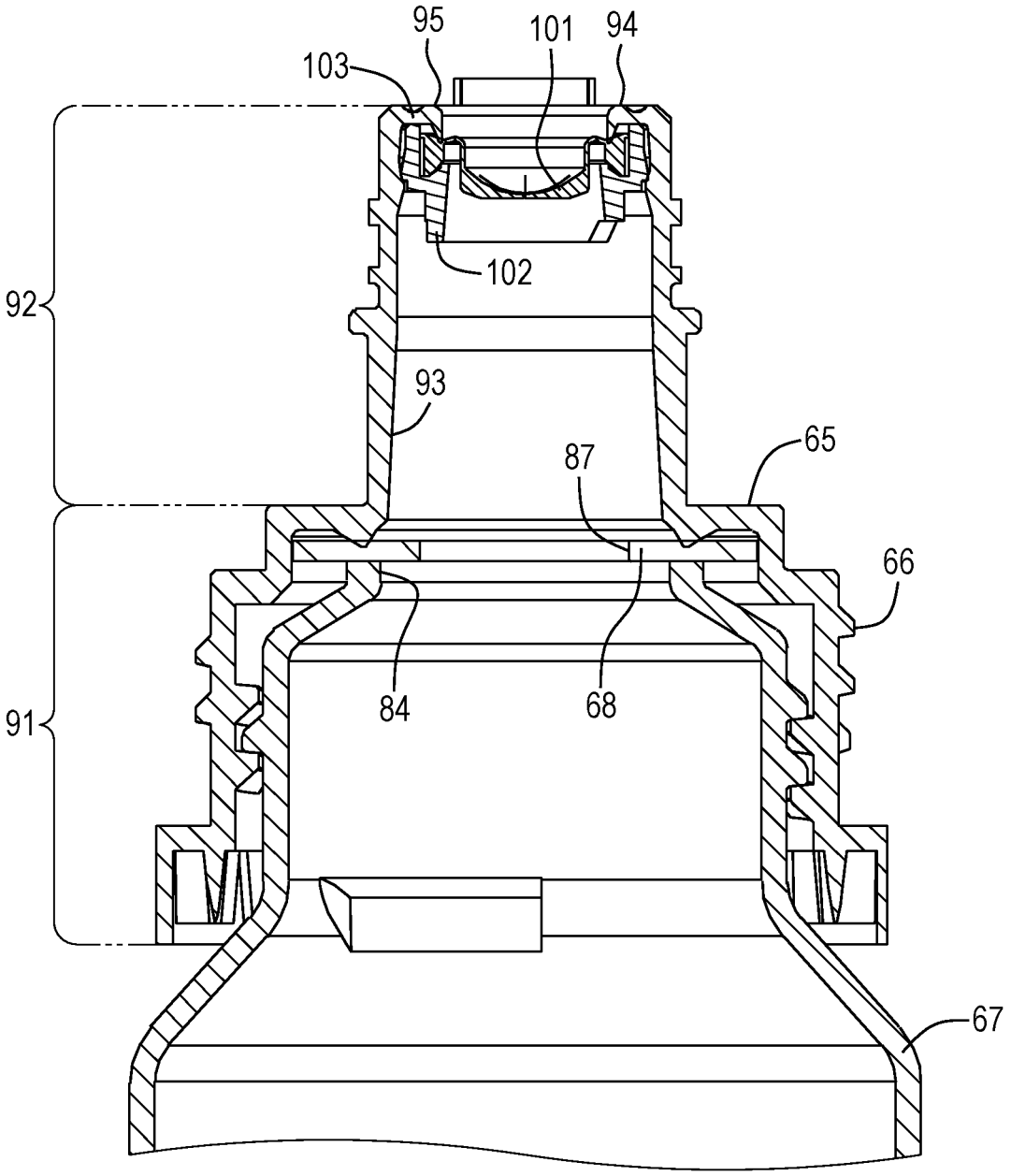
FIG. 9 is a cross-sectional view taken along line B-B in FIG. 6.
Figure 10:
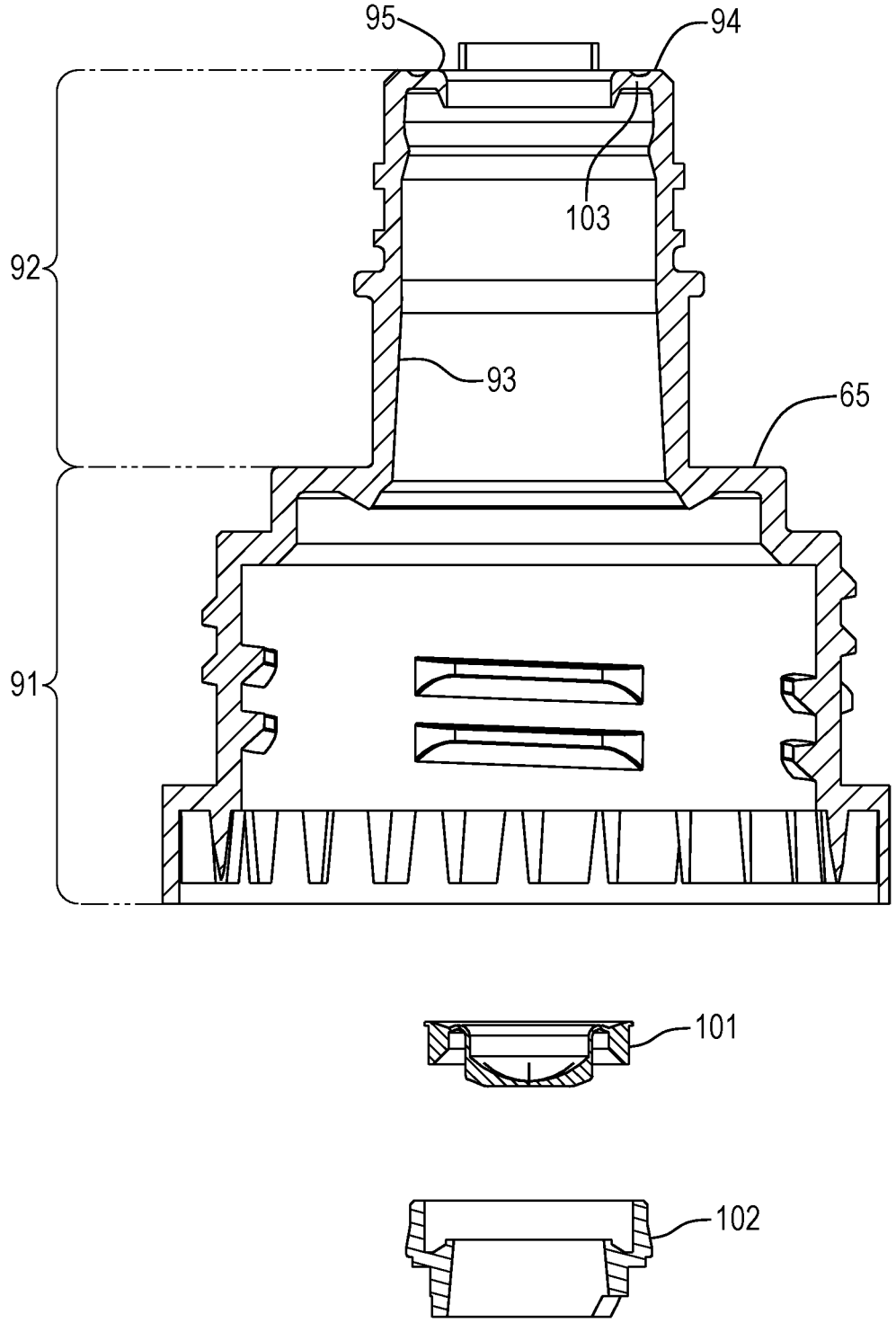
FIG. 10 is an exploded cross-sectional view showing an ink outlet forming portion, a valve, and a holder according to the first embodiment.
Figure 11:
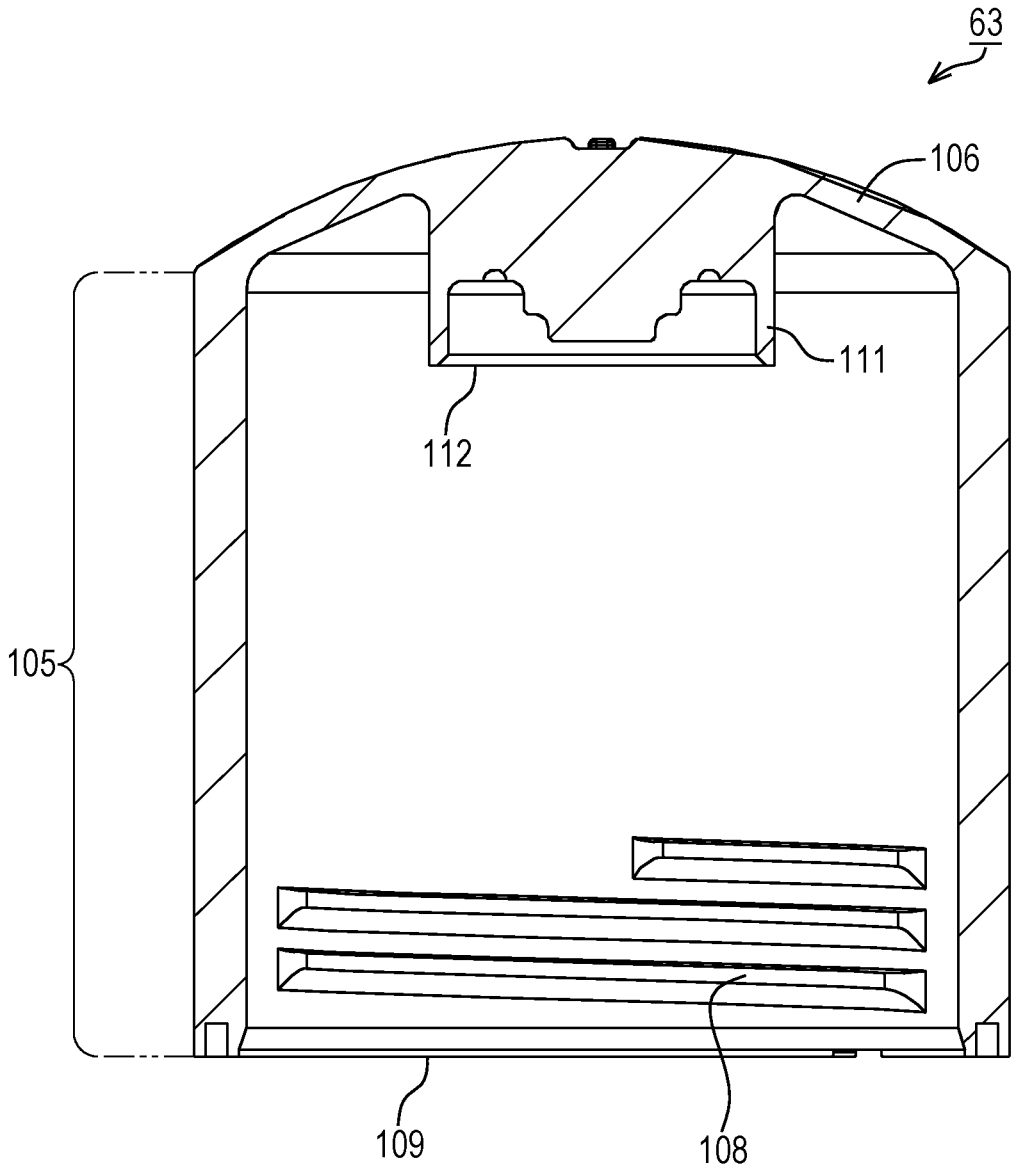
FIG. 11 is an enlarged view of a lid member shown in FIG. 8.
Figure 12:
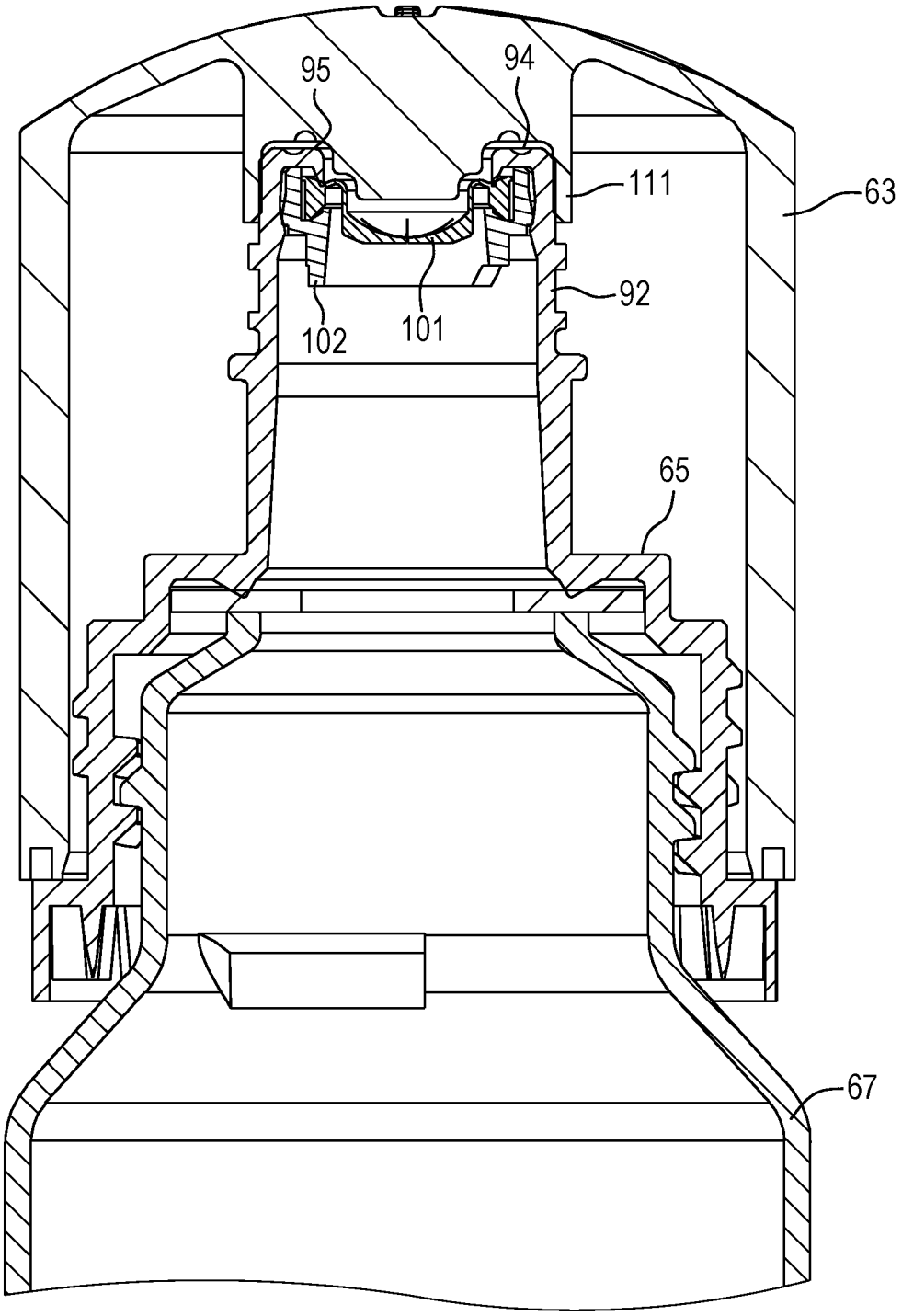
FIG. 12 is a cross-sectional view taken along line C-C in FIG. 5.

Next, a configuration of a bottle set will be described. FIG. 5 is an external view showing a bottle set. FIGS. 6 and 7 are exploded views showing the bottle set. Also, FIG. 8 is a cross-sectional view taken along line A-A in FIG. 7, and FIG. 9 is a cross-sectional view taken along line B-B in FIG. 6. FIG. 10 is an exploded cross-sectional view showing an ink outlet forming portion, a valve, and a holder, and FIG. 11 is an enlarged view of the lid portion shown in FIG. 8. Also, FIG. 12 is a cross-sectional view taken along line C-C in FIG. 5.

As shown in FIG. 5, in the present embodiment, the bottle set 61 can be used to inject ink into the ink tank 31. Ink for replenishing the above-described ink tank 31 is stored in the bottle set 61.

The bottle set 61 includes an ink bottle 62 and a lid member 63. As shown in FIG. 6, the lid member 63 is configured to be able to be attached to and removed from the ink bottle 62.

Here, before the bottle set 61 is opened (before use), an adhesive seal (not shown) is adhered so as to span between the lid member 63 and the ink bottle 62. Also, the adhesive seal is configured to be broken when the lid member 63 and the ink bottle 62 are separated during opening (during use). Accordingly, it is possible to easily determine whether or not the bottle set 61 is unopened.

The ink bottle 62 includes an ink containing portion 64 and an ink outlet forming portion 65, which is an example of an outlet portion and a nozzle portion. The ink storage portion 64 is a portion that can store ink. The ink outlet forming portion 65 is a portion through which the ink in the ink storage portion 64 can flow out of the ink bottle 62.

The lid member 63 is constituted so as to be able to cover a portion of the ink outlet forming portion 65 in a state of being attached to the ink bottle 62. A later-described ink outlet 95 is formed in the ink outlet forming portion 65. The ink in the ink storage portion 64 flows out of the ink bottle 62 from the ink outlet 95 of the ink outlet forming portion 65. The lid member 63 is constituted so as to be able to cover the ink outlet 95 of the ink outlet forming portion 65 in a state of being attached to the ink bottle 62. Note that in the bottle set 61, the state in which the lid member 63 is attached to the ink bottle 62 (FIG. 5) is called a covered state. The covered state is a state in which the lid member 63 is attached to the ink bottle 62 and the ink outlet 95 is covered by the lid member 63.

Note that as shown in FIG. 6, the lid member 63 can be engaged to the ink outlet forming portion 65 via a screw 66 that is formed in the ink outlet forming portion 65. That is, in the present embodiment, the lid member 63 can be attached to the ink bottle 62 through engagement via a screw 66. Note that a screw (not shown) that can engage with the screw 66 of the ink outlet forming portion 65 is formed on the lid member 63. Due to the screw on the lid member 63 and the screw 66 on the ink outlet forming portion 65 engaging, the lid member 63 can be attached to the ink bottle 62.

In the present embodiment, as shown in FIG. 7, the ink bottle 62 includes a container main body portion 67, which is an example of a container portion, a seal member 68, and the ink outlet forming portion 65. The ink outlet forming portion 65 is provided at the end portion of the container main body portion 67. In the present embodiment, the outer shell of the ink bottle is constituted by combining the container main body portion 67 and the ink outlet forming portion 65 into one. The seal member 68 is interposed between the container main body portion 67 and the ink outlet forming portion 65. The container main body portion 67 and the ink outlet forming portion 65 are combined as one ink bottle 62 with the seal member 68 interposed therebetween by engagement via a screw 69. Note that a screw (described later) that can engage with the screw 69 of the container main body portion 67 is formed on the ink outlet forming portion 65. Due to the screw in the ink outlet forming portion 65 and the screw 69 in the container main body portion 67 engaging, the container main body portion 67 and the ink outlet forming portion 65 are combined as one ink bottle 62.

As shown in FIG. 8, the container main body portion 67 is formed into a container shape and can store ink. The container main body portion 67 and the ink outlet forming portion 65 are constituted separately from each other. A screw 81 is formed in the ink outlet forming portion 65. The container main body portion 67 and the ink outlet forming portion 65 can engage with each other through the screw 69 on the container main body portion 67 and the screw 81 on the ink outlet forming portion 65. Also, the container main body portion 67 and the ink outlet forming portion 65 can be attached to and detached from each other. By twisting (turning) the ink outlet forming portion 65 relative to the container main body portion 67, the ink outlet forming portion 65 can be removed from the container main body portion 67.

The ink is contained in the container main body portion 67. In the present embodiment, the container main body portion 67 is constituted by an elastic material. The container main body portion 67 includes a cylindrical body portion 82, a cylindrical engaging portion 83, and an opening portion 84. For example, resin materials such as polyethylene terephthalate (PET), nylon, polyethylene, polypropylene, and polystyrene, metal materials such as iron materials and aluminum, or the like can be used as the material of the container main body portion 67. The body portion 82 and the engaging portion 83 are formed integrally with each other. The body portion 82 is located on the side opposite to the seal member 68 side of the engaging portion 83. The engaging portion 83 is located on the seal member 68 side of the body portion 82. The engaging portion 83 is formed thinner than the body portion 82. The screw 69 is formed on a side portion 83A outside of the engaging portion 83. The screw 69 is provided protruding from the side portion 83. The opening portion 84 is formed at an end portion 83B on the side of the engaging portion 83 opposite to the body portion 82 side, through the ink containing portion 64 in the container main body portion 67. The opening portion 84 is open to the seal member 68 side.

According to the above-described configuration, the container main body portion 67 is formed into a hollow container shape including the body portion 82 and the engaging portion 83. In the ink bottle 62, ink of a volume obtained by combining the body portion 82 and the engaging portion 83 can be stored. In the ink bottle 62, the internal space obtained by combining the body portion 82 and the engaging portion 83 of the container main body portion 67 constitutes the ink containing portion 64.

An opening portion 87 is formed in the seal member 68. The ink in the container main body portion 67 can flow out to the ink outlet forming portion 65 after passing through the opening portion 87 of the seal member 68. According to this configuration, the seal member 68 is sandwiched between the end portion 83B of the container main body portion 67 and the ink outlet forming portion 65, and therefore it is possible to suppress a case in which the ink leaks from between the container main body portion 67 and the ink outlet forming portion 65. Note that various materials, such as polyethylene foam materials and elastic materials such as rubber and elastomer, can be used as the material of the seal member 68.

As shown in FIG. 8, the ink outlet forming portion 65 includes a coupling portion 91 and a tube portion 92. The coupling portion 91 and the tube portion 92 are formed integrally with each other. For example, resin such as polyethylene terephthalate (PET), nylon, polyethylene, polypropylene, and polystyrene can be used as the materials of the ink outlet forming portion 65. The coupling portion 91 has a cylindrical exterior. The screw 81 is provided on the side surface inside of the coupling portion 91. The coupling portion 91 is a part that is engaged with the container main body portion 67 by the screw 81. The inner diameter of the coupling portion 91 is wider than the outer diameter of the engaging portion 83 of the container main body portion 67. The screw 81 is formed on the inside of the coupling portion 91 and the screw 69 is formed on the outside of the engaging portion 83 of the container main body portion 67. Also, due to the screw 81 on the inside of the coupling portion 91 engaging with the screw 69 on the outside of the engaging portion 83, the ink outlet forming portion 65 and the container main body portion 67 engage. In the state in which the ink outlet forming portion 65 and the container main body portion 67 are engaged, the coupling portion 91 of the ink outlet forming portion 65 covers the engaging portion 83 of the container main body portion 67.

As shown in FIG. 9, the tube portion 92 protrudes from the engaging portion 91 toward the side opposite to the container main body portion 67 side. The tube portion 92 has a cylindrical (also called "pipe-shaped") form. A lead-out flow path 93 is formed inside of the tube portion 92. The lead-out flow path 93 is provided in a region that overlaps with the region of the opening 84 when the ink outlet forming portion 65 is viewed in a plan view from the opening portion 84 side to the tube portion 92 side. The lead-out flow path 93 is a hollow region that overlaps with the region of the opening portion 84 in plan view in the tube portion 92.

An ink outlet 95 through which the ink from the container main body portion 67 can flow out is formed on the end surface 94 on the side opposite to the coupling portion 91 side of the tube portion 92. The ink outlet 95 is an example of an outflow port. The end surface 94 faces the side opposite to the container main body portion 67 side. The ink outlet 95 is open to the side opposite to the coupling portion 91 side of the tube portion 92. The ink outlet 95 is open at the end surface 94. For this reason, the end surface 94 surrounds the ink outlet 95. The ink outlet 95 is located at the terminal end of the lead-out flow path 93. In other words, the lead-out flow path 93 guides the ink in the container main body portion 67 to the ink outlet 95.

Ink contained in the container main body portion 67 can flow to the outside from the ink outlet 95 via the lead-out flow path 93 of the tube portion 92. As a result, the ink in the container main body portion 67 can flow from the opening portion 84, through the lead-out flow path 93, and out of the container main body portion 67 from the ink outlet 95. When a user injects the ink in the ink bottle 62 into the ink tank 31, the ink outlet 95 is inserted into the ink injection portion 33 of the ink tank 31. Then, the user injects the ink in the container main body portion 67 into the ink tank 31 from the ink injection portion 33. Note that when the user injects the ink in the ink bottle 62 into the ink tank 31, the user removes the lid member 63 (FIG. 7) from the ink bottle 62 and thereafter carries out the injection task.

As shown in FIG. 9, the ink outlet forming portion 65 is provided with a valve 101 and a holder 102. The valve 101 openably seals the ink outlet 95. In the ink outlet forming portion 65, the valve 101 is provided inside of the lead-out flow path 93 and openably seals the ink outlet 95 from inside of the lead-out flow path 93. In other words, the valve 101 openably spans across the lead-out flow path 93. The valve 101 is constituted by an elastic material such as rubber or elastomer and seals the ink outlet 95 in a state in which no external force acts thereon. The connection pipe 49 of the ink tank 31 is inserted into the ink outlet 95, and when a pressing force is furthermore applied to the valve 101 by the connection pipe 49, the valve 101 opens. Then, when the connection pipe 49 is taken out from the ink outlet 95 and the external force acting on the valve 101 is canceled, the valve 101 closes.

As shown in FIG. 10, the valve 101 and the holder 102 can be separated from the ink outlet forming portion 65. That is, the ink outlet forming portion 65, the valve 101, and the holder 102 are constituted separately from each other. The valve 101 is inserted into the lead-out flow path 93 from the coupling portion 91 side of the ink outlet forming portion 65. The holder 102 is a member that restricts falling-off of the valve 101, and as shown in FIG. 9, the holder 102 is provided on the coupling portion 91 side of the valve 101. The holder 102 is also inserted into the lead-out flow path 93 from the coupling portion 91 side of the ink outlet forming portion 65. The valve 101 is sandwiched by the holder 102 and a flange portion 103 of the ink outlet forming portion 65. Accordingly, the ink outlet forming portion 65, the valve 101, and the holder 102 are assembled integrally. Note that the flange portion 103 is a wall that extends in the inner diameter direction of the tube portion 92 from the inside surface of the tube portion 92. The surface on the side opposite to the coupling portion 91 side of the flange portion 103 corresponds to the end surface 94.

The lid member 63 is constituted by an elastic member, and as shown in FIG. 11, the lid member 63 can be divided into a cylindrical body portion 105 and a top plate portion 106. For example, resin such as polyethylene terephthalate (PET), nylon, polyethylene, polypropylene, and polystyrene can be used as the materials of the lid member 63. In the present embodiment, the lid member 63 is formed through injection molding of the resin material.

The body portion 105 and the top plate portion 106 are formed together integrally. As shown in FIG. 8, in the bottle set 61, the body portion 105 of the lid member 63 is located on the ink outlet forming portion 65 side. As shown in FIG. 11, the top plate portion 106 is located at one end portion of the body portion 105. In the present embodiment, the top plate portion 106 is located on the side of the body portion 105 that is opposite to the ink outlet forming portion 65 side. The cylindrical body portion 105 protrudes from the top plate portion 106 to the ink containing portion 64 (FIG. 8) side. The top plate portion 106 closes one end of the cylindrical body portion 105. In other words, the portion that closes one end of the cylindrical body portion 105 is the top plate portion 106. The top plate portion 106 may have an opening formed therein. Even if an opening is provided, the top plate portion 106 extends in a direction intersecting the cylindrical body portion 105, and therefore the top plate portion 106 is expressed as closing one end of the cylindrical body portion 105.

Also, in the example shown in FIG. 11, the top plate portion 106 is formed into a curved plate shape. However, various plates, such as a flat plate, a plate including recesses and protrusions, or a corrugated plate can be used as the configuration of the top plate portion 106. Also, the top plate portion 106 is not limited to a plate shape, and various shapes such as a sphere, a circular cone, or a pyramid, can be used thereas. In each shape, the portion that closes one end of the cylindrical body portion 105 corresponds to the top plate portion 106.

A screw 108 is provided on the side surface inside of the body portion 105. The body portion 105 is a portion that is engaged with the ink outlet forming portion 65 (FIG. 9) by the screw 108. The screw 108 is provided at a position in the body portion 105 that is near the end portion 109 with respect to the top plate portion 106. The screw 108 is formed on the inside of the body portion 105 and a screw 66 is formed on the outside of the engaging portion 91 of the ink outlet forming portion 65. Also, due to the screw 108 inside of the body portion 105 engaging with the screw 66 outside of the coupling portion 91 of the ink outlet forming portion 65, the lid member 63 and the ink outlet forming portion 65 engage with each other. In the state in which the lid member 63 and the ink outlet forming portion 65 are engaged, the lid member 63 covers the tube portion 92 of the ink outlet forming portion 65. That is, the state in which the lid member 63 and the ink outlet forming portion 65 are engaged is the covered state.

Here, as shown in FIG. 11, a stopper portion 111 is provided on the top plate portion 106 of the lid member 63. The stopper portion 111 is provided on the ink outlet forming portion 65 (FIG. 8) side of the top plate portion 106, that is, the end portion 109 side of the top plate portion 106. The stopper portion 111 protrudes from the top plate portion 106 to the end portion 109. The stopper portion 111 is provided in the central region of the top plate portion 106. When the lid member 63 is attached to the ink bottle 62, the stopper portion 111 is provided at a location facing (opposing) the ink outlet 95 of the tube portion 92. The stopper portion 111 has a cylindrical exterior.

As shown in FIG. 11, the distance (depth) from the end portion 109 of the body portion 105 to the end portion 112 of the stopper portion 111 is shorter (less) than the distance from the end portion 113 of the coupling portion 91 of the ink outlet forming portion 65 (FIG. 8) to the end portion 94 of the tube portion 92. That is, when the lid member 63 is attached to the ink bottle 62, as shown in FIG. 12, which is a cross-sectional view taken along line C-C in FIG. 5, the stopper portion 111 covers the end surface 94 from the outside of the tube portion 92. Here, the inner diameter of the cylindrical stopper portion 111 is slightly smaller than the outer diameter of the end portion on the end surface 94 side of the tube portion 92. For this reason, when the lid member 63 is attached to the ink outlet forming portion 65, the ink outlet 95 of the ink outlet forming portion 65 is sealed by the stopper portion 111. That is, in a state in which the lid member 63 is attached to the ink bottle 62, the ink outlet 95 is sealed due to the stopper portion 111 coming into contact with the tube portion 92. Note that at this time, the lid member 63 is set so as not to come into contact with the inner diameter portion of the ink outlet 95. Similarly, at this time, the lid member 63 is set so as not to come into contact with the valve 101.

Accordingly, the ink outlet 95 can be sealed. For this reason, if the ink in the container main body portion 67 is not completely injected into the ink tank 31 and ink is left over in the container main body portion 67, or the like, the ink can be stored in the ink bottle 62 in a state in which the ink outlet 95 is covered with the lid member 63. Accordingly, the ink can be stored in a state in which the air-tightness in the sealed container main body portion 67 is increased. As a result, it is possible to suppress a case in which the liquid component of the ink in the ink bottle 62 evaporates or the ink deteriorates.

Here, at least one of the ink outlet forming portion 65 and the lid member 63 is constituted by polypropylene. As described above, the inner diameter of the cylindrical stopper portion 111 is slightly smaller than the outer diameter of the end portion on the end surface 94 side of the tube portion 92. For this reason, when the lid member 63 is attached to the ink outlet forming portion 65, the end surface 94 of the tube portion 92 of the ink outlet forming portion 65 is press-fit inside of the cylindrical stopper portion 111. Accordingly, the ink outlet 95 of the ink outlet forming portion 65 is more easily hermetically sealed by the stopper portion 111. When the end surface 94 of the tube portion 92 of the ink outlet forming portion 65 is press-fit inside of the cylindrical stopper portion 111, stress occurs in the tube portion 92 and the ink outlet forming portion 65 and the cylindrical stopper portion 111. For this reason, warping (deformation) tends to occur in the tube portion 92 of the ink outlet forming portion 65 and the stopper portion 111 of the lid member 63.

When the ink comes into contact with the lid member 63 or the ink outlet forming portion 65 in a state in which stress is acting on the lid member 63 or the ink outlet forming portion 65, deformation of the material, a reduction in toughness, or the like may occur. Polypropylene is a material in which this sort of deformation and reduction in toughness is not likely to occur. In the bottle set 61, at least one of the ink outlet forming portion 65 and the lid member 63 is constituted by polypropylene, and therefore it is possible to make it less likely that deformation and a reduction in toughness will occur in at least one of the ink outlet forming portion 65 and the lid member 63. Accordingly, since it is possible to make it easier to maintain the sealed state of the ink outlet 95, it is easy to improve the convenience of the bottle set 61. Note that among the ink outlet forming portion 65 and the lid member 63, other than an example in which only the ink outlet forming portion 65 is constituted by polypropylene and an example in which only the lid member 63 is constituted by polypropylene, it is also possible to use an example in which both the ink outlet forming portion 65 and the lid member 63 are constituted by polypropylene.

Also, in the ink bottle 62, as described above, the valve 101 that openably seals the ink outlet 95 is provided in the ink outlet forming portion 65. For this reason, in a state in which the lid member 63 is removed from the ink bottle 62, for example, even if the ink bottle 62 is tilted with the ink outlet 95 directed downward, by using the valve 101, it is easy to suppress a case in which the ink in the container main body portion 67 leaks out from the ink outlet 95. Also, in a state in which the lid member 63 is removed from the ink bottle 62, for example, even if the ink bottle 62 shakes when the ink bottle 62 is transported, it is easy to suppress a case in which the ink in the container main body portion 67 leaks out from the ink outlet 95 using the valve 101.

Figure 13:
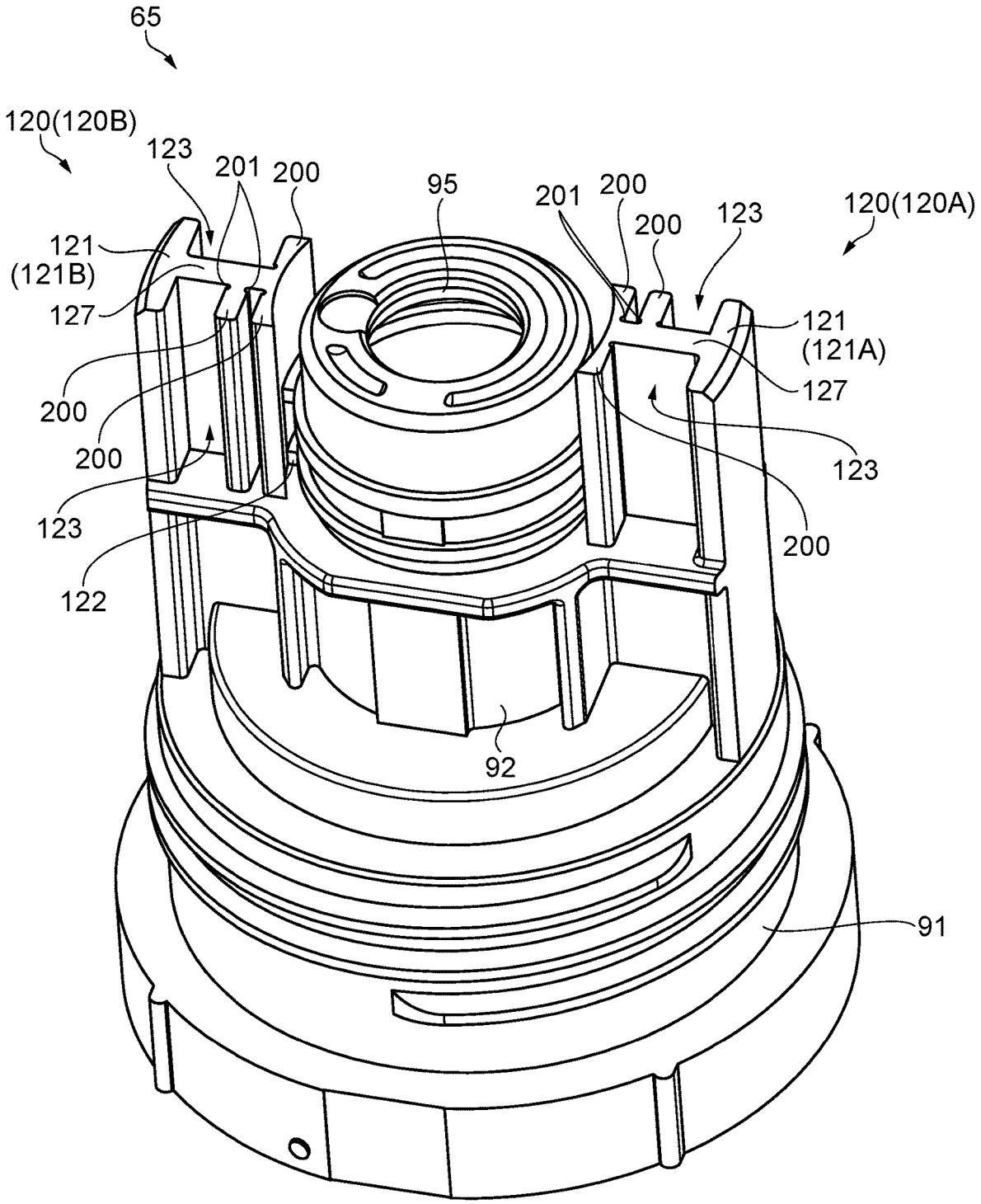
FIG. 13 is a perspective view showing the ink outlet forming portion according to the first embodiment.
Figure 14:
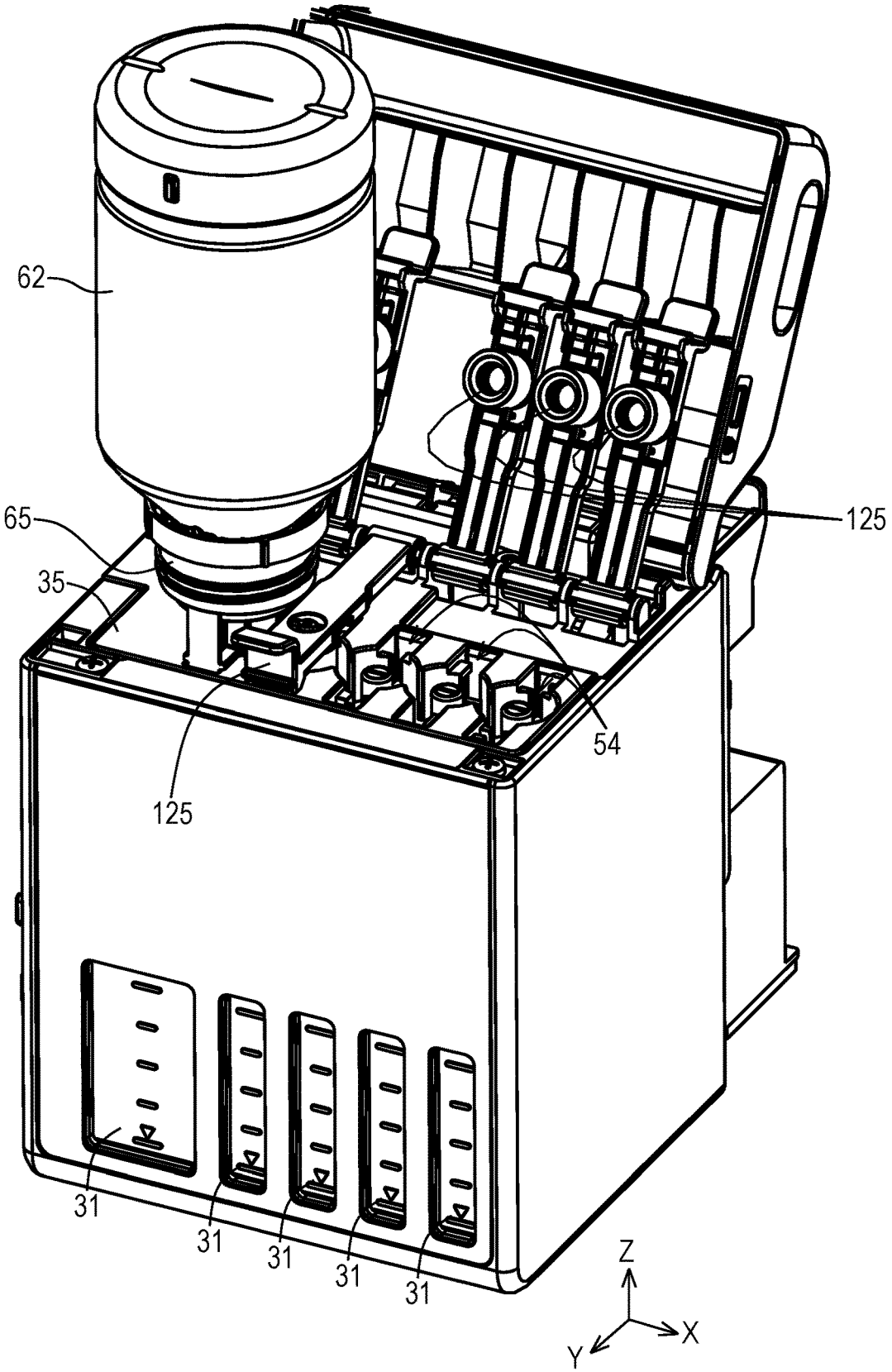
FIG. 14 is a perspective view showing an ink bottle and an ink supply apparatus according to the first embodiment.
Figure 15:
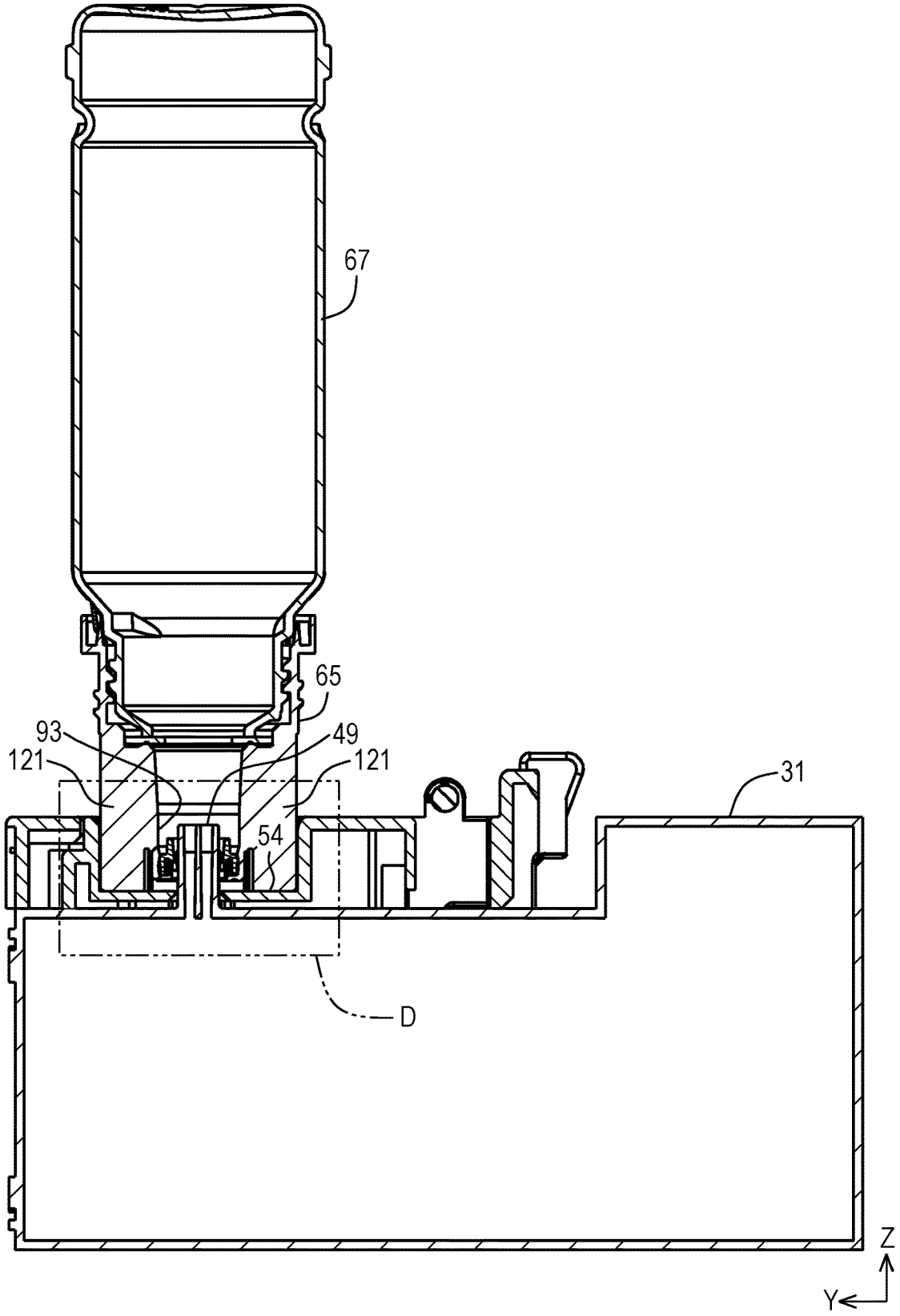
FIG. 15 is a cross-sectional view showing the ink bottle and the ink supply apparatus according to the first embodiment.
Figure 16:
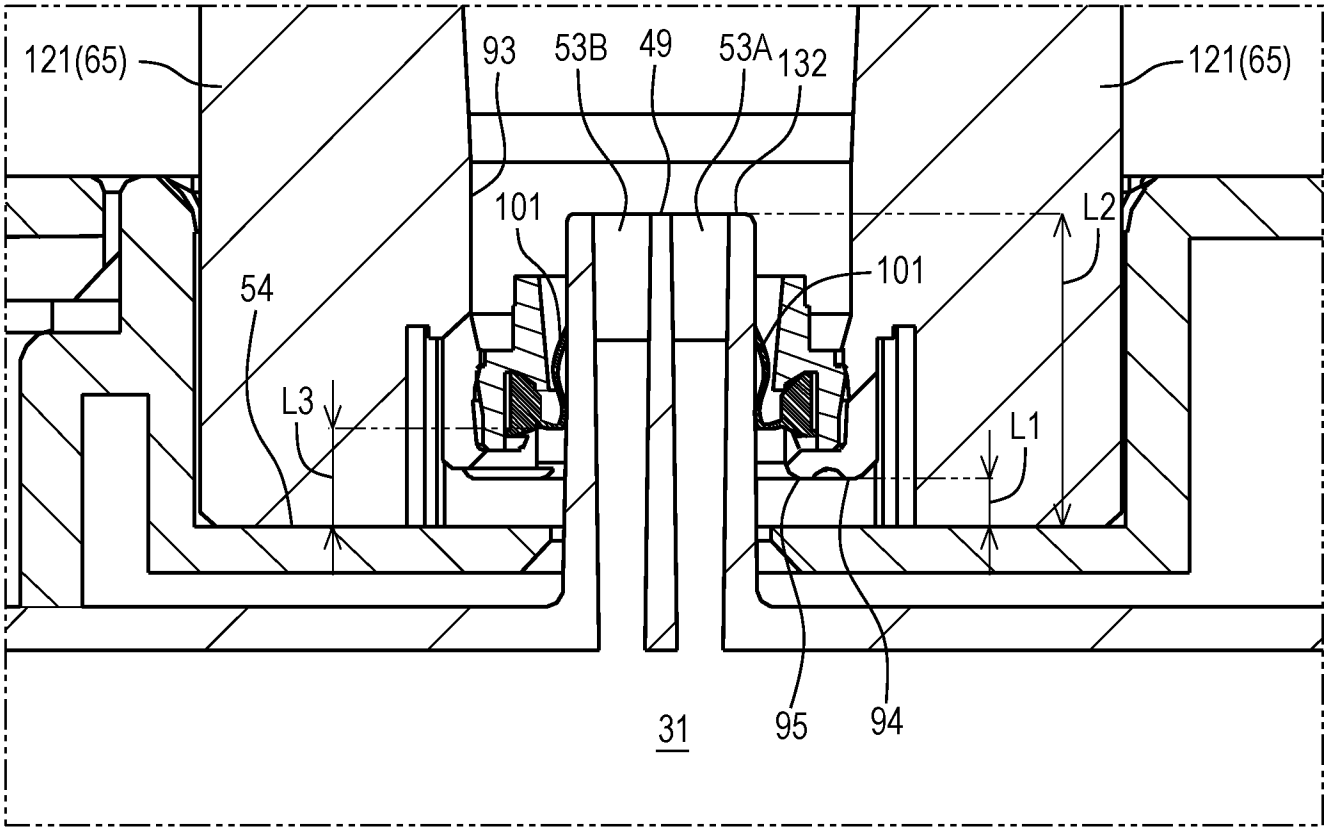
FIG. 16 is an enlarged view of a D portion shown in FIG. 15.

Next, a configuration of the ink outlet forming portion 65 will be described. FIG. 13 is a perspective view showing the ink outlet forming portion. Also, FIG. 14 is a perspective view showing the ink bottle and an ink supply apparatus, and FIG. 15 is a cross-sectional view showing the ink bottle and the ink supply apparatus. Also, FIG. 16 is an enlarged view of a D portion shown in FIG. 15.

As shown in FIG. 13, the ink outlet forming portion 65 includes an erroneous insertion prevention portion 120 that is inserted into a corresponding slot portion 54 (recessed portion) of an ink tank 31 and prevents erroneous insertion into the ink tank 31. The erroneous insertion prevention portion 120 includes detachable protrusions 200, and is inserted into the slot portion 54 by attaching and detaching the protrusions 200 according to the shape of the slot portion 54. In a region outside of the ink outlet 95 in a radial direction centered about the ink outlet 95, the erroneous insertion prevention portion 120 is formed protruding past the ink outlet 95 in the opposite direction to the container main body portion 67 in the axial direction using the center of the ink outlet 95 as an axial center.

As shown in the present embodiment, if there are multiple (in the example shown in FIG. 4, five) ink tanks 31 and there are multiple connection pipes 49 (ink inlets), the shapes of the slot portions 54 (recessed portions) corresponding to the connection pipes 49 differ. In this case, the erroneous insertion prevention portion 120 can be made to correspond to the slot portions 54 with different shapes by attaching and detaching the protrusions 200 according to the shape of the slot portion 54 corresponding to the ink tank 31. Accordingly, erroneous insertion can be reliably prevented.

Multiple erroneous insertion prevention portions 120 are provided on each ink outlet forming portion 65. In the ink outlet forming portion 65 of the present embodiment, a first erroneous insertion prevention portion 120A and a second erroneous insertion prevention portion 120B that oppose each other are formed centered about the ink outlet 95.

Also, positioning portions 121 (121A and 121B) are provided on the erroneous insertion prevention portions 120. In a plan view of the ink outlet forming portion 65 in an orientation from the tube portion 92 to the coupling portion 91, the positioning portion 121A and the positioning portion 121B are located outside of the tube portion 92.

In the ink outlet forming portion 65, the positioning portion 121A and the positioning portion 121B are provided on the coupling portion 91. In a plan view of the ink outlet forming portion 65 in an orientation from the tube portion 92 to the coupling portion 91, the positioning portion 121A and the positioning portion 121B are provided at positions opposing each other on both sides of the tube portion 92. The positioning portion 121A and the positioning portion 121B protrude from the coupling portion 91 to the end surface 94 side. The positioning portion 121A and the positioning portion 121B are coupled to the tube portion 92 via the coupling portions 122.

A base portion 127 that supports the protrusions 200 is provided on the first erroneous insertion prevention portion 120A. The base portion 127 is formed extending from the positioning portion 121A to the tube portion 92. Also, the protruding portions 200 are formed on both side surfaces of the base portion 127.

Also, notches 201 are formed on the end portions on the base portion 127 side of the protrusions 200. In the present embodiment, one notch 201 is formed along each end portion of the base portion 127 of each protrusion 200. The notches 201 are for easily removing the protrusions 200 from the base portion 127, and due to an external force being applied to a protrusion 200, stress is concentrated using the notches 201 as origins, whereby the protrusion 200 can easily be removed from the base portion 127.

Note that the configuration of the base portion 127, the protrusions 200, and the notches 201 of the second erroneous insertion prevention portion 120B will not be described since it is similar to the configuration of the first erroneous insertion prevention portion 120A.

Also, the protrusions 200 of the first erroneous insertion prevention portion 120A and the second erroneous insertion prevention portion 120B are attached and detached so as to be point-symmetrical with respect to the center of the ink outlet 95. That is, as shown in FIG. 13, the form of the first erroneous insertion prevention portion 120A and the form of the second erroneous insertion prevention portion 120B are in a point-symmetrical relationship with respect to the center of the ink outlet 95. Accordingly, the ink bottle 62 can be attached to the slot portion 54 even if it has been rotated 180 degrees.

The first erroneous insertion prevention portion 120A and the second erroneous insertion prevention portion 120B are provided with third recessed portions 123. In other words, the third recessed portions 123 are formed on the portions from which the protrusions 200 have been removed. The third recessed portions 123 engage with the first protruding portions 59 that are formed in the slot portion 54 of the adapter 35 of the ink supply apparatus 4 (FIG. 4). If the first protruding portions 59 of a slot portion 54 and the third recessed portions 123 of the positioning portion 121 fit together, the ink outlet forming portion 65 can be inserted into the slot portion 54. As described above, in one slot portion 54, the first protruding portions 59 are disposed point-symmetrically with respect to the central point of the connection pipe 49. Accordingly, in a plan view of the ink outlet forming portion 65 in an orientation from the tube portion 92 to the coupling portion 91, the positioning portion 121A and the positioning portion 121B are arranged point-symmetrically with respect to the central axis CL (not shown) of the ink outlet 95. Furthermore, the protrusions 200 of the first erroneous insertion prevention portion 120A and the protrusions 200 of the second erroneous insertion prevention portion 120B are arranged point-symmetrically with respect to the central axis CL of the ink outlet 95. The first erroneous insertion prevention portion 120A and the second erroneous insertion prevention portion 120B are formed at equal intervals at an interval with a phase angle of 180 degrees with respect to the central axis CL of the ink outlet 95. Note that in a plan view of the ink outlet forming portion 65 in an orientation from the tube portion 92 to the coupling portion 91, the central axis CL is an axis that passes through the center of the region surrounded by the circumferential edge of the ink outlet 95, perpendicular to the region.

When the third recessed portions 123 of the positioning portions 121 fit together with the first protruding portions 59 of the slot portion 54 in the adapter 35 of the ink supply apparatus 4 (FIG. 4), as shown in FIG. 14, the ink outlet forming portion 65 of the ink bottle 62 can be inserted into the slot portion 54. In the ink outlet forming portion 65, the size in the radial direction of the tube portion 92 is smaller than that of the coupling portion 91 (see FIG. 13). Accordingly, the ink outlet forming portion 65 can be inserted into the slot portion 54 with the tube portion 92 of the ink outlet forming portion 65 away from the cap 125 that covers the adjacent slot portion 54. At this time, as shown in FIG. 15, which is a cross-sectional view, the connection pipe 49 of the ink tank 31 is inserted into the lead-out flow path 93 of the ink outlet forming portion 65. Note that FIG. 15 shows a cross-section taken when the ink tank 31 and the ink bottle 62 shown in FIG. 14 are cut along the YZ plane. At this time, as shown in FIG. 16, which is an enlarged view of the D portion in FIG. 15, the valve 101 is opened by the connection pipe 49.

In the state in which the positioning portions 121 of the ink outlet forming portion 65 abut the bottom of the slot portion 54, the distance L1 from the bottom of the slot portion 54 to the end surface 94 and the distance L2 from the bottom of the slot portion 54 to the leading end portion 132 of the connection pipe 49 are in the relationship indicated by Equation (1) below.

$$L1<L2 \quad (1)$$

According to Equation (1) above, in the state in which the ink outlet forming portion 65 abuts the bottom of the slot portion 54, the leading end portion 132 of the connection pipe 49 advances into the lead-out flow path 93 from the ink outlet 95. That is, in the state in which the ink outlet forming portion 65 abuts the bottom of the slot portion 54, the connection pipe 49 is connected to the ink outlet 95. Accordingly, in the ink tank 31, the connection pipe 49 is provided so as to be able to connect to the ink outlet 95.

At this time, a distance L3 from the bottom of the slot portion 54 to the valve 101, the distance L1, and the distance L2 are in the relationship indicated by Equation (2) below.

$$L1<L3<L2 \quad (2)$$

According to the relationship indicated by Equation (2), the valve 101 is opened by the connection pipe 49 in a state in which the positioning portions 121 of the ink outlet forming portion 65 abut the bottom of the slot portion 54. According to the above-described relationship, the positioning portions 121 restrict the position of the valve 101 with respect to the ink tank 31 when in a state in which the ink outlet 95 is connected to the connection pipe 49 and the valve 101 is open.

Accordingly, the lead-out flow path 93 and the inner portion of the ink tank 31 communicate with each other via the flow path 53A and the flow path 53B of the connection pipe 49. For this reason, the ink in the ink bottle 62 can be injected into the ink tank 31 via the connection pipe 49. As described above, the inner portion of the connection pipe 49 is divided into two parts, namely the flow path 53A and the flow path 53B. Accordingly, the ink in the ink bottle 62 can be injected into the ink tank 31 through one of the flow path 53A and the flow path 53B, and the air in the ink tank 31 can be injected into the ink bottle 62 through the other of the flow path 53A and the flow path 53B. That is, the exchange of the ink in the ink bottle 62 and the air in the ink tank 31 (referred to as "gas-liquid exchange") can be prompted rapidly via the connection pipe 49 that is divided into the flow path 53A and the flow path 53B. As a result, according to the present embodiment, the injection of the ink into the ink tank 31 from the ink bottle 62 is performed rapidly, and therefore convenience is improved.

Next, a method for manufacturing an ink bottle will be described. FIGS. 17 to 22 are perspective views showing a method for manufacturing an ink bottle. Note that in the present embodiment, a method for manufacturing the above-described ink bottle 62 will be described.

First, an ink outlet forming portion 65' including the first erroneous insertion prevention portion 120A and the second erroneous insertion prevention portion 120B is integrally molded. Then, predetermined protrusions 200 among the protrusions 200 formed on the first and second erroneous insertion prevention portions 120A and 120B are removed.

Note that the predetermined protrusions 200 of the present embodiment indicate protrusions 200 that are to be removed in order to enable attachment (insertion) to the slot portions 54 (54*a*, 54*b*, 54*c*, 54*d*, 54*e*).

Here, the first erroneous insertion prevention portion 120A and the second erroneous insertion prevention portion 120B are formed so as to be point-symmetrical with respect to the central axis CL of the ink outlet 95. Furthermore, notches 201 are formed on the end portions on the base portion 127 side of the protrusions 200.

Then, the ink outlet forming portion 65, the seal member 68, and the container main body portion 67 are combined. Accordingly, the ink bottle 62 is formed.

Note that the step of removing the predetermined protrusions 200 may be performed after the ink outlet forming portion 65, the seal member 68, and the container main body portion 67 are combined.

Hereinafter, a method for forming the ink outlet forming portion 65 in particular will be described in detail.

Figure 17:
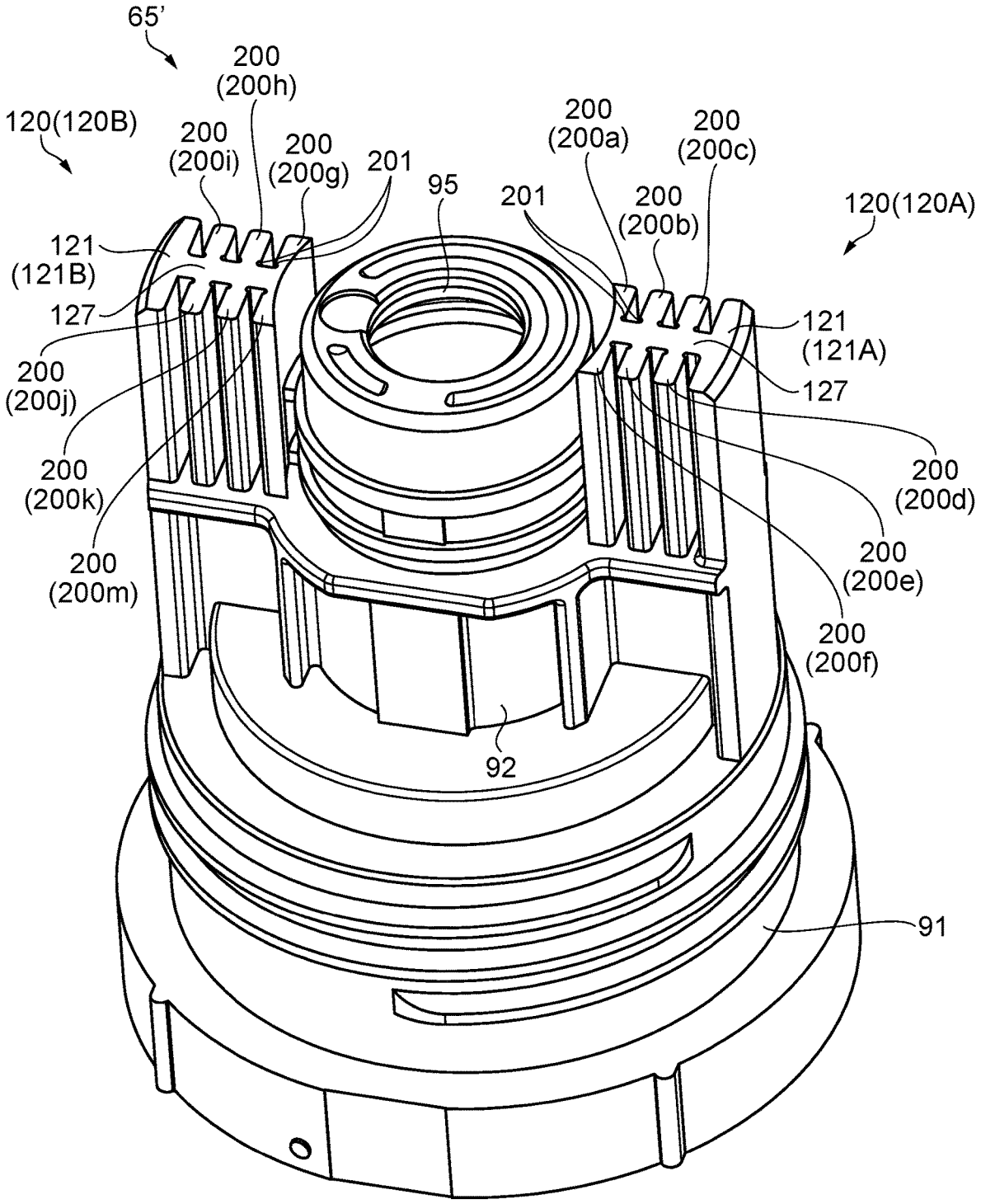
FIG. 17 is a perspective view showing a method for manufacturing the ink bottle according to the first embodiment.

FIG. 17 shows the form of the ink outlet forming portion 65' after the ink outlet forming portion 65' including the first erroneous insertion prevention portion 120A and the second erroneous insertion prevention portion 120B has been molded integrally, that is, before the protrusions 200 are removed.

Specifically, a total of six protrusions 200, namely protrusions 200*a*, 200*b*, 200*c*, 200*d*, 200*e*, and 200*f* are formed on the first erroneous insertion prevention portion 120A of the ink outlet forming portion 65'. Also, a total of six protrusions 200, namely protrusions 200*g*, 200*h*, 200*i*, 200*j*, 200*k*, and 200*m*, are formed on the second erroneous insertion prevention portion 120B.

Then, the protrusion 200*a* of the first erroneous insertion prevention portion 120A and the protrusion 200*m* of the second erroneous insertion prevention portion 120B are formed so as to be point-symmetrical with respect to the central axis CL of the ink outlet 95.

Similarly, the protrusion 200*b* and the protrusion 200*k* are formed so as to be point-symmetrical with respect to the central axis CL of the ink outlet 95. Also, the protrusion 200*c* and the protrusion 200*j* are formed so as to be point-symmetrical with respect to the central axis CL of the ink outlet 95. Also, the protrusion 200*d* and the protrusion 200*i* are formed so as to be point-symmetrical with respect to the central axis CL of the ink outlet 95. Also, the protrusion 200*e* and the protrusion 200*h* are formed so as to be point-symmetrical with respect to the central axis CL of the ink outlet 95. Also, the protrusion 200*f* and the protrusion 200*g* are formed so as to be point-symmetrical with respect to the central axis CL of the ink outlet 95.

Note that the configuration of the other ink outlet forming portion 65 is as described above, and therefore description thereof is omitted.

Next, the predetermined protrusions 200 are removed.

Here, first, a method for forming an ink bottle 62*a* (ink outlet forming portion 65*a*) corresponding to the slot portion

54*a* among the multiple slot portions 54*a*, 54*b*, 54*c*, 54*d*, and 54*e* shown in FIG. 4 will be described.

In this case, the predetermined protrusions 200*c*, 200*d*, and 200*e* in the first erroneous insertion prevention portion 120A are removed. Furthermore, the predetermined protrusions 200*h*, 200*i*, and 200*j* in the second erroneous insertion prevention portion 120B are removed.

That is, the first erroneous insertion prevention portion 120A and the second erroneous insertion prevention portion 120B are formed so as to be point-symmetrical with respect to the central axis CL of the ink outlet 95.

Note that if these protrusions 200 are to be removed, a finger, a tool such as a pincette, a cutter, or a nipper, a dedicated cutting jig, or the like is used, for example. When the protrusions 200 are to be removed, the protrusions 200 can be easily removed from the base portions 127 using the notches 201 as base points since the notches 201 are formed on the end portions on the base portion 127 side of the protrusions 200.

Figure 18:
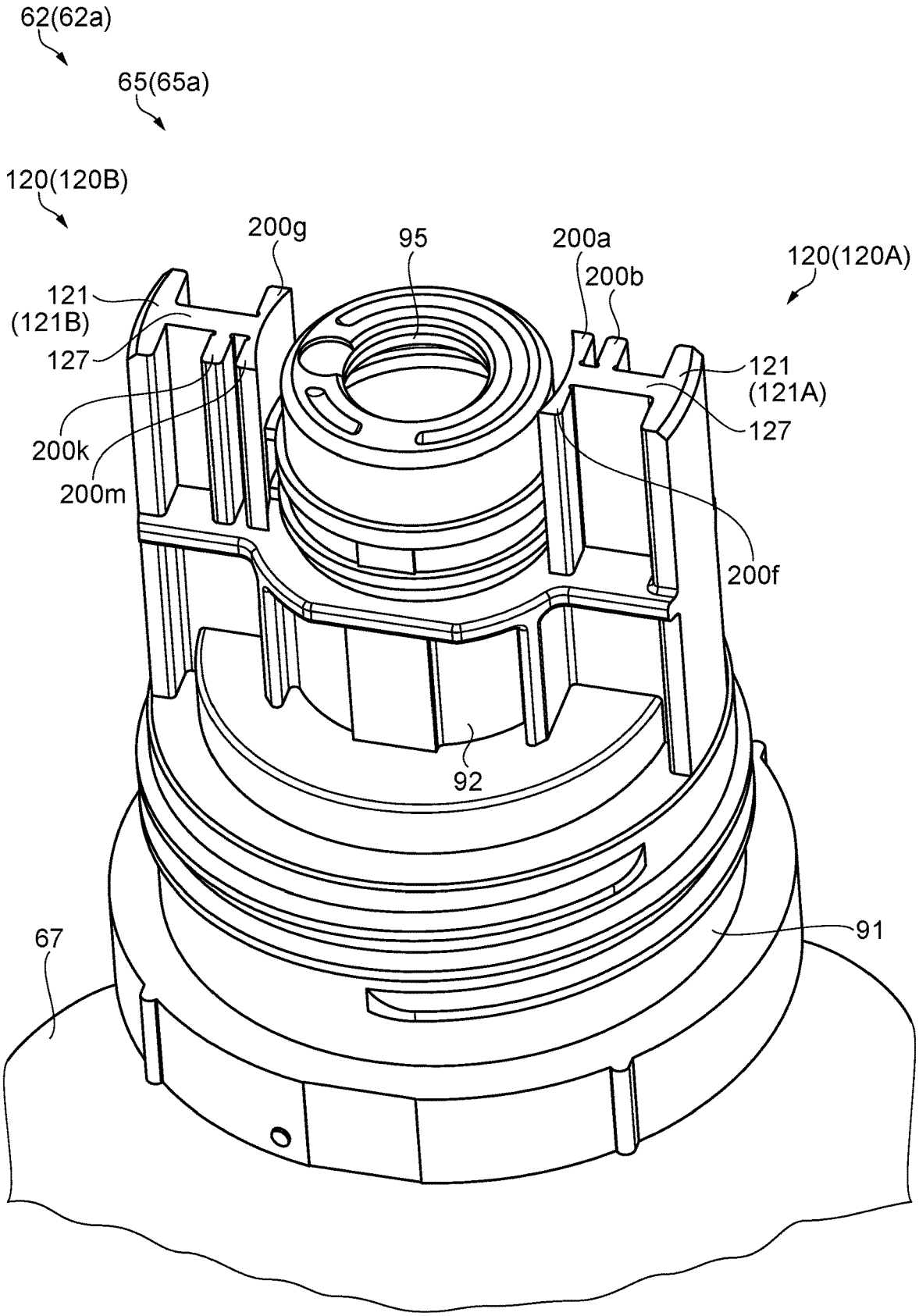
FIG. 18 is a perspective view showing a method for manufacturing the ink bottle according to the first embodiment.

Also, as shown in FIG. 18, the ink outlet forming portion 65*a* including the first erroneous insertion prevention portion 120A and the second erroneous insertion prevention portion 120B, which are point-symmetrical to the center of the ink outlet 95, is formed. Also, the ink outlet forming portion 65*a*, the seal member 68, and the container main body portion 67 are combined to form the ink bottle 62*a*. The ink bottle 62*a* can be inserted into the slot portion 54*a* and the ink can be supplied to the ink tank 31 corresponding to the slot portion 54*a*.

Next, a method for manufacturing an ink bottle 62*b* (ink outlet forming portion 65*b*) corresponding to the slot portion 54*b* (FIG. 4) will be described.

In this case, in the ink outlet forming portion 65' (FIG. 17) in which the protrusions 200 have not yet been removed, the predetermined protrusions 200*a*, 200*b*, and 200*c* in the first erroneous insertion prevention portion 120A are removed. Furthermore, the predetermined protrusions 200*j*, 200*k*, and 200*m* in the second erroneous insertion prevention portion 120B are removed. That is, the first erroneous insertion prevention portion 120A and the second erroneous insertion prevention portion 120B are formed so as to be point-symmetrical with respect to the central axis CL of the ink outlet 95.

Figure 19:
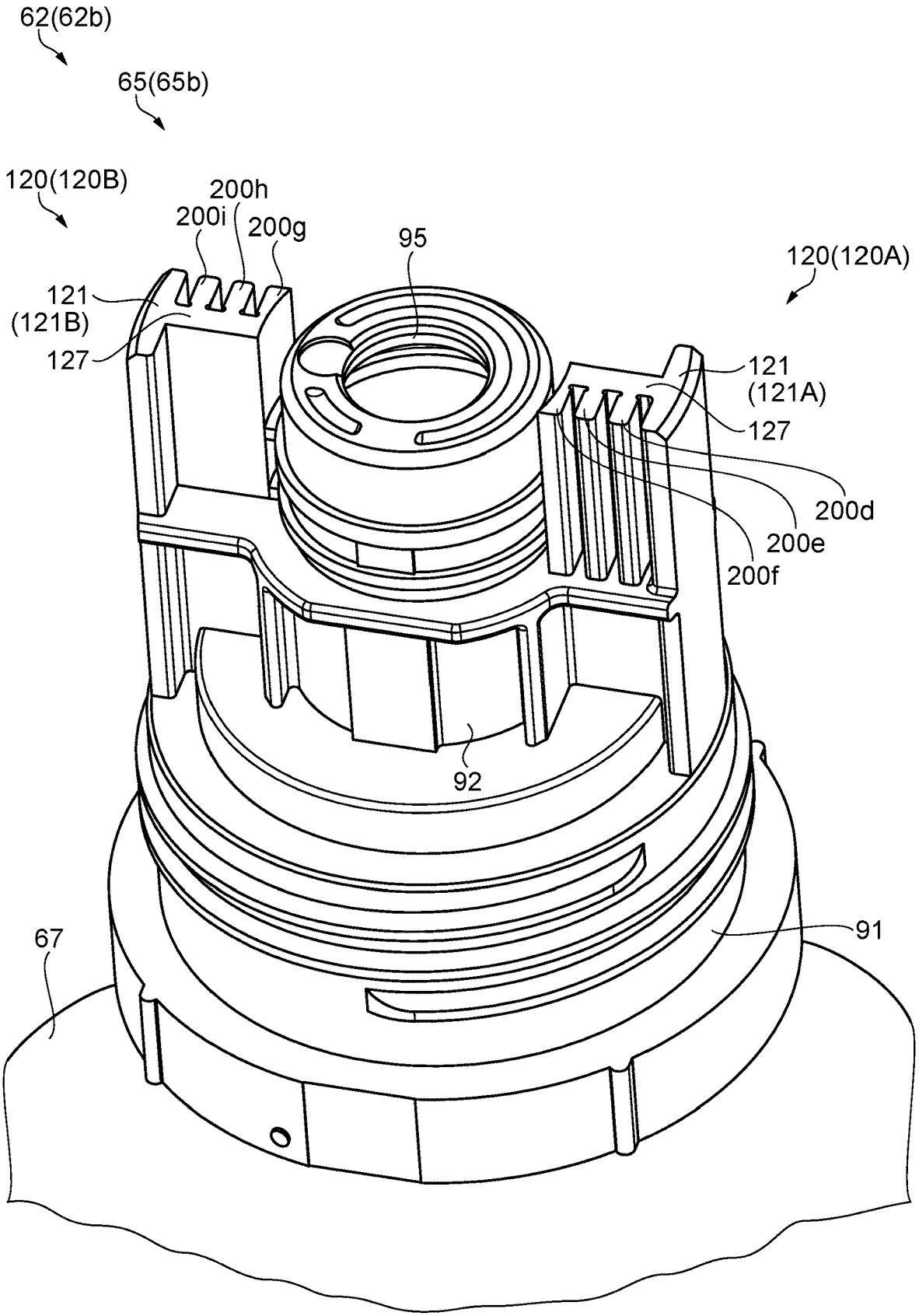
FIG. 19 is a perspective view showing a method for manufacturing the ink bottle according to the first embodiment.

Also, as shown in FIG. 19, the ink outlet forming portion 65*b* including the first erroneous insertion prevention portion 120A and the second erroneous insertion prevention portion 120B, which are point-symmetrical to the center of the ink outlet 95, is formed. Also, the ink outlet forming portion 65*b*, the seal member 68, and the container main body portion 67 are combined to form the ink bottle 62*b*. The ink bottle 62*b* can be inserted into the slot portion 54*b* and the ink can be supplied to the ink tank 31 corresponding to the slot portion 54*b*.

Next, a method for manufacturing an ink bottle 62*c* (ink outlet forming portion 65*c*) corresponding to the slot portion 54*c* (FIG. 4) will be described.

In this case, in the ink outlet forming portion 65' (FIG. 17) in which the protrusions 200 have not yet been removed, the predetermined protrusions 200*a*, 200*b*, and 200*f* of the first erroneous insertion prevention portion 120A are removed. Furthermore, the predetermined protrusions 200*g*, 200*k*, and 200*m* in the second erroneous insertion prevention portion 120B are removed. That is, the first erroneous insertion prevention portion 120A and the second erroneous insertion prevention portion 120B are formed so as to be point-symmetrical with respect to the central axis CL of the ink outlet 95.

Figure 20:
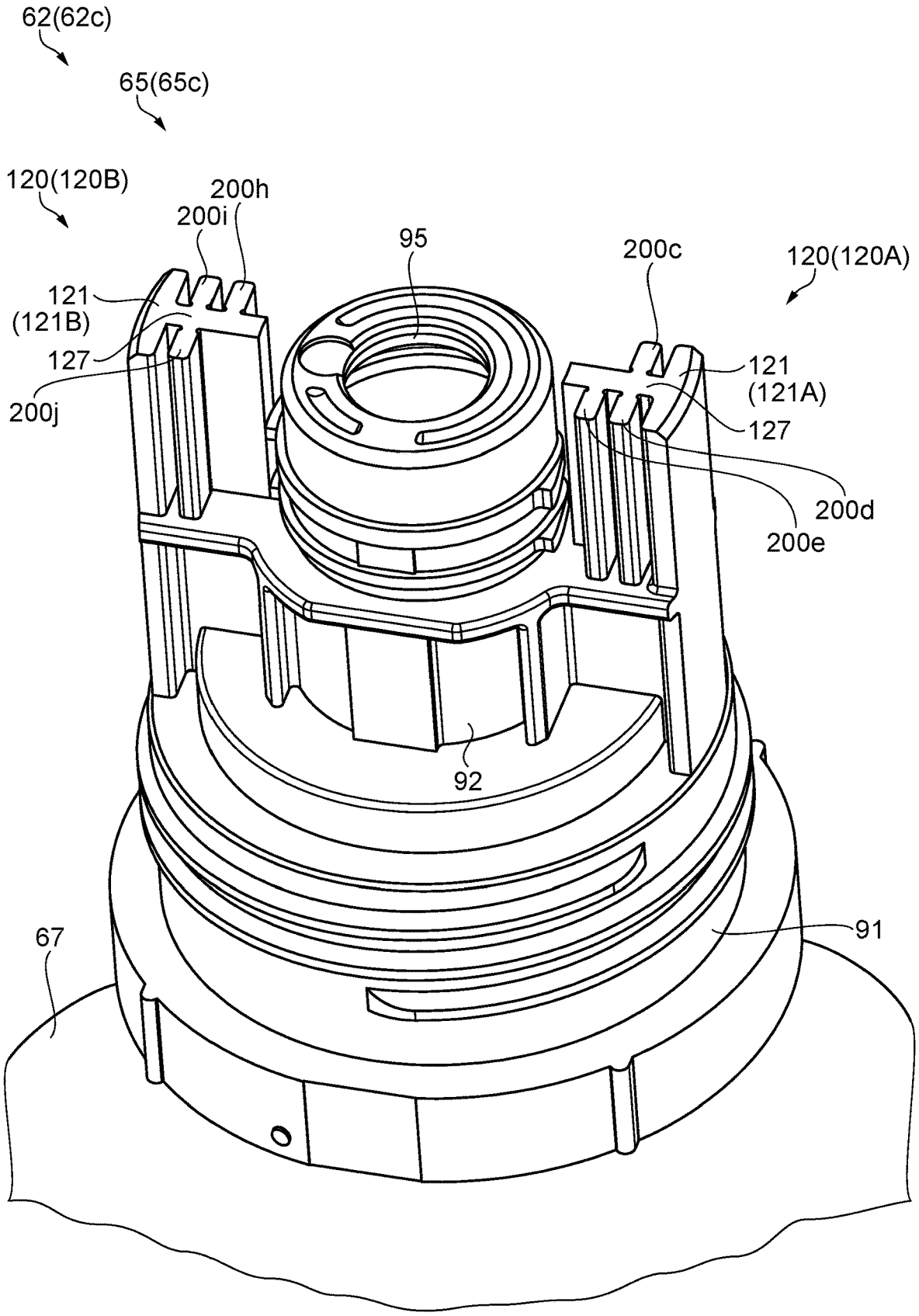
FIG. 20 is a perspective view showing a method for manufacturing the ink bottle according to the first embodiment.

Also, as shown in FIG. 20, the ink outlet forming portion 65*c* including the first erroneous insertion prevention portion 120A and the second erroneous insertion prevention portion 120B, which are point-symmetrical to the center of the ink outlet 95, is formed. Also, the ink outlet forming portion 65*c*, the seal member 68, and the container main body portion 67 are combined to form the ink bottle 62*c*. The ink bottle 62*c* can be inserted into the slot portion 54*c* and the ink can be supplied to the ink tank 31 corresponding to the slot portion 54*c*.

Next, a method for manufacturing an ink bottle 62*d* (ink outlet forming portion 65*d*) corresponding to the slot portion 54*d* (FIG. 4) will be described.

In this case, in the ink outlet forming portion 65' (FIG. 17) in which the protrusions 200 have not yet been removed, the predetermined protrusions 200*d*, 200*e*, and 200*f* of the first erroneous insertion prevention portion 120A are removed. Furthermore, the predetermined protrusions 200*g*, 200*h*, and 200*i* in the second erroneous insertion prevention portion 120B are removed. That is, the first erroneous insertion prevention portion 120A and the second erroneous insertion prevention portion 120B are formed so as to be point-symmetrical with respect to the central axis CL of the ink outlet 95.

Figure 21:
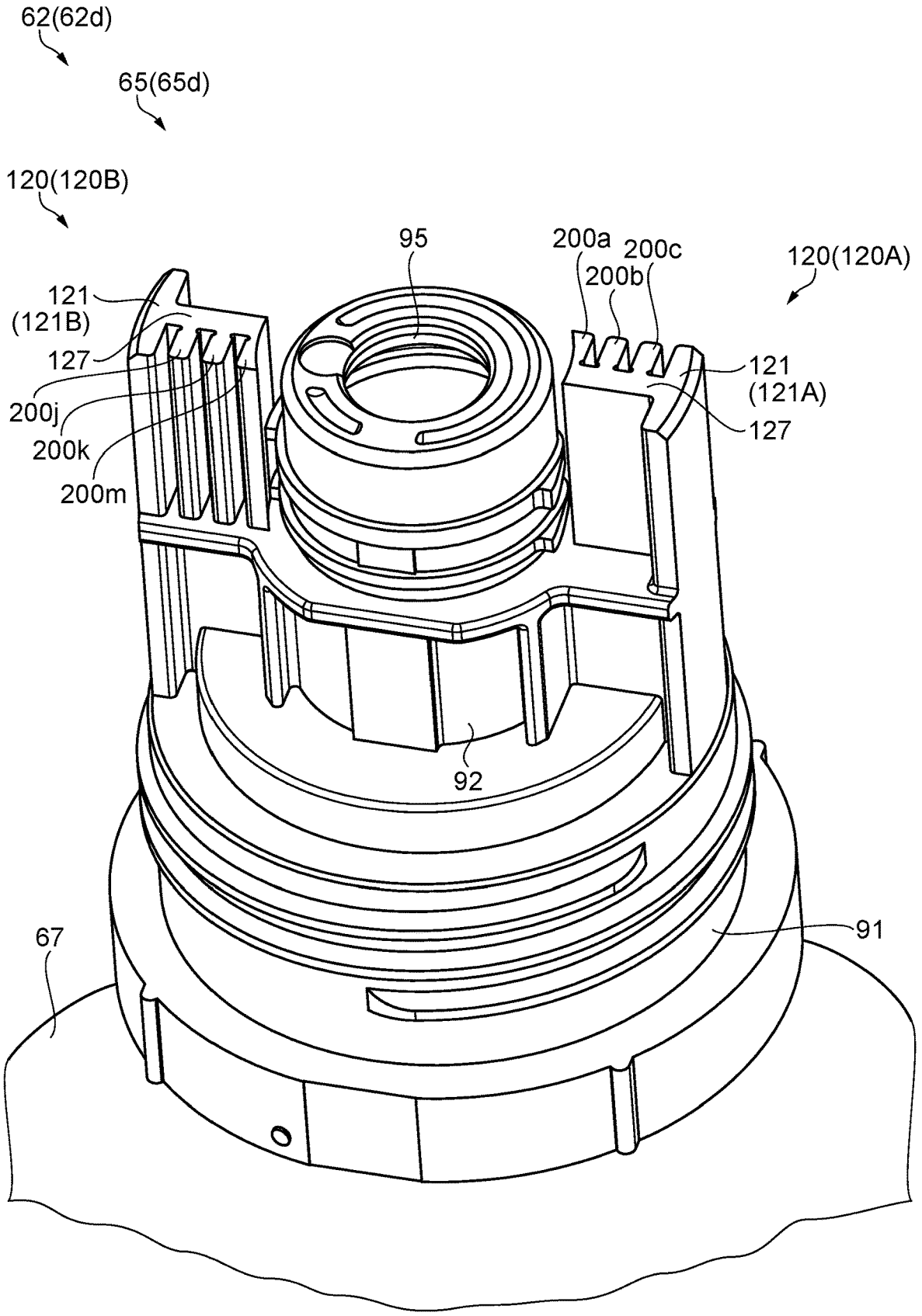
FIG. 21 is a perspective view showing a method for manufacturing the ink bottle according to the first embodiment.

Also, as shown in FIG. 21, the ink outlet forming portion 65*d* including the first erroneous insertion prevention portion 120A and the second erroneous insertion prevention portion 120B, which are point-symmetrical to the center of the ink outlet 95, is formed. Also, the ink outlet forming portion 65*d*, the seal member 68, and the container main body portion 67 are combined to form the ink bottle 62*d*. The ink bottle 62*d* can be inserted into the slot portion 54*d* and the ink can be supplied to the ink tank 31 corresponding to the slot portion 54*d*.

Next, a method for manufacturing an ink bottle 62*e* (ink outlet forming portion 65*e*) corresponding to the slot portion 54*e* (FIG. 4) will be described.

In this case, in the ink outlet forming portion 65' (FIG. 17) in which the protrusions 200 have not yet been removed, the predetermined protrusions 200*a*, 200*c*, and 200*f* of the first erroneous insertion prevention portion 120A are removed. Furthermore, the predetermined protrusions 200*g*, 200*j*, and 200*m* in the second erroneous insertion prevention portion 120B are removed. That is, the first erroneous insertion prevention portion 120A and the second erroneous insertion prevention portion 120B are formed so as to be point-symmetrical with respect to the central axis CL of the ink outlet 95.

Figure 22:
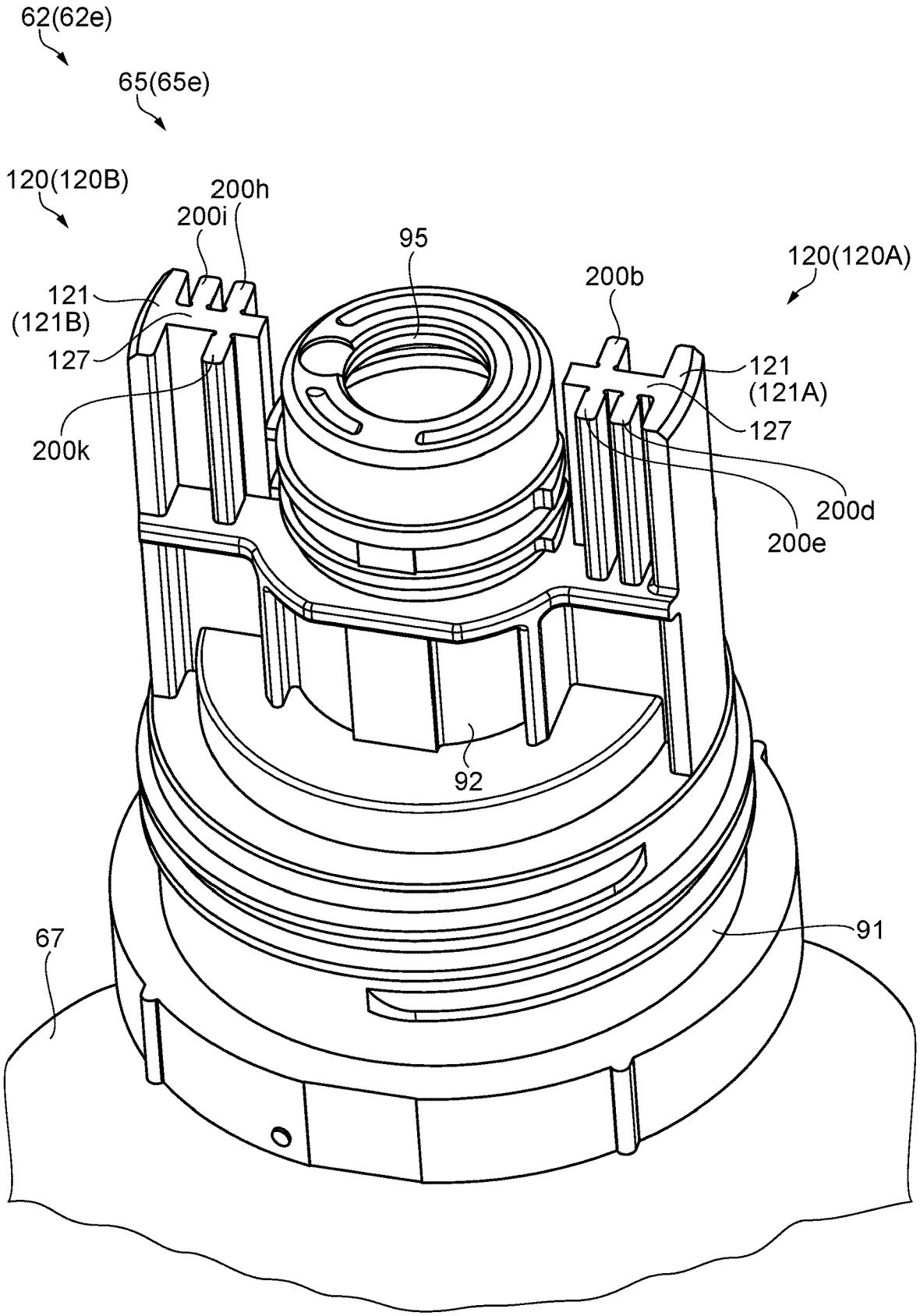
FIG. 22 is a perspective view showing a method for manufacturing the ink bottle according to the first embodiment.

Also, as shown in FIG. 22, the ink outlet forming portion 65*e* including the first erroneous insertion prevention portion 120A and the second erroneous insertion prevention portion 120B, which are point-symmetrical to the center of the ink outlet 95, is formed. Also, the ink outlet forming portion 65*e*, the seal member 68, and the container main body portion 67 are combined to form the ink bottle 62*e*. The ink bottle 62*e* can be inserted into the slot portion 54*e* and the ink can be supplied to the ink tank 31 corresponding to the slot portion 54*e*.

Note that when the predetermined protrusions 200 are removed from the ink outlet forming portion 65' shown in FIG. 17, traces resulting from the protrusions 200 being removed can be seen through eyesight or a stereoscopic microscope (at about 2 to 10-fold magnification) on the side surfaces of the base portion 127. Examples of the traces on the side surfaces of the base portion 127 include linear traces of the notches 201 and fracture traces (recesses and protrusions, etc.) resulting from the protrusions 200 being removed.

According to the present embodiment described above, the following effects can be obtained.

In the ink bottle 62, the first erroneous insertion prevention portion 120A and the second erroneous insertion prevention portion 120B are present, and therefore it is possible to reliably prevent erroneous insertion (erroneous attachment) into the slot portions 54 (ink tanks 31).

Also, after the common ink outlet forming portions 65' are first formed, the ink outlet forming portions 65 are formed by removing the predetermined protrusions 200, and therefore there is no need to prepare a molding apparatus for each ink outlet forming portion 65, and thus the molding apparatus can be used in common (streamlined), and therefore a reduction in the manufacturing cost can be expected.

Also, since the user can easily remove the protrusions 200, ink bottles 62 having ink outlet forming portions 65 of various forms can be formed, and thus the overall convenience for the user can be improved.

Second Embodiment

Next, a second embodiment will be described.

In the first embodiment, a mode was used in which the first erroneous insertion prevention portions 120A and the second erroneous insertion prevention portions 120B in the ink bottles 62 correspond to the slot portions 54, but in the present embodiment, a configuration of an ink bottle used in common for all slot portions 54 will be described.

Note that the basic configurations of the ink ejection system, the bottle set, and the like are similar to those of the first embodiment, and therefore description thereof is omitted.

Figure 23:
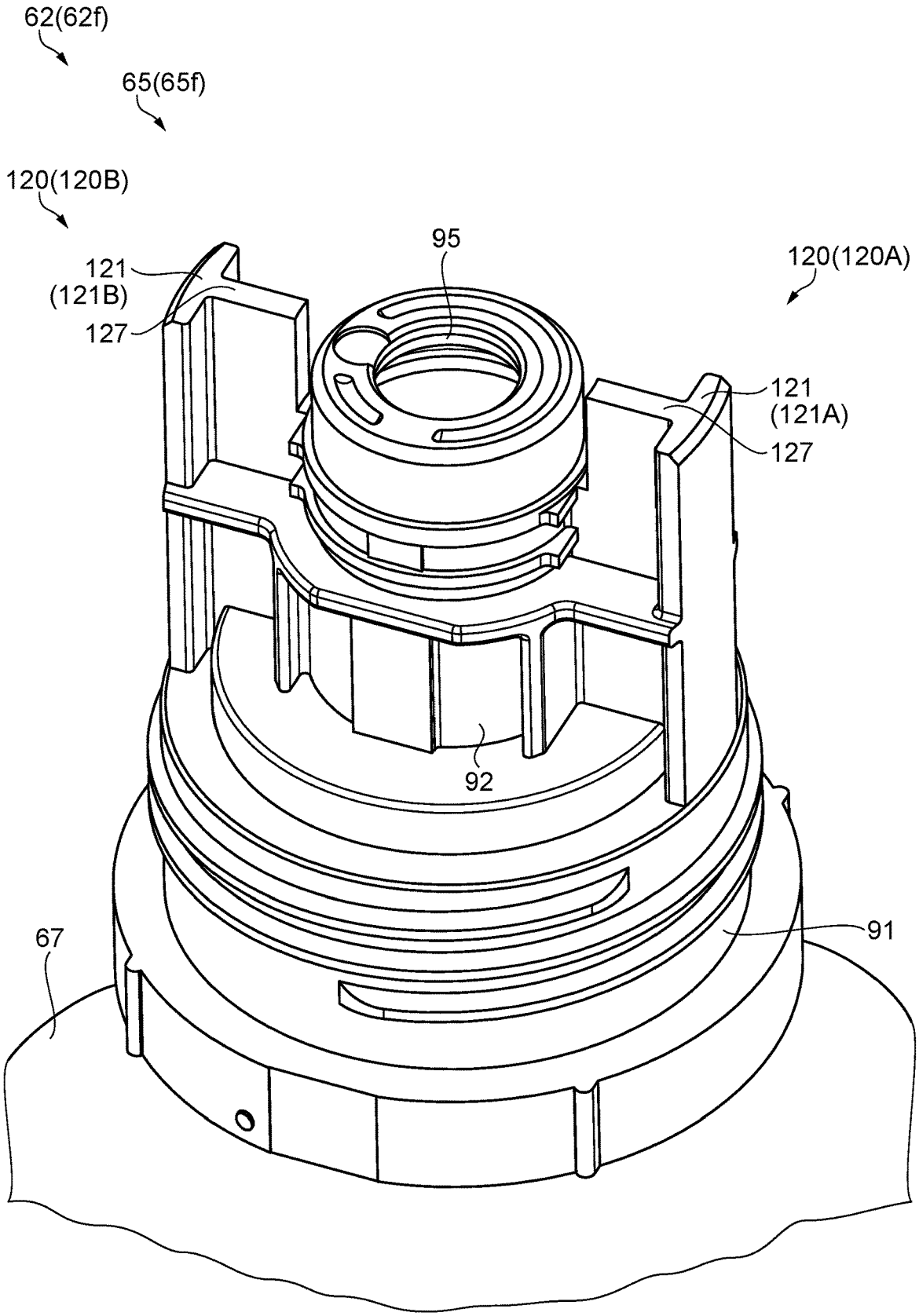
FIG. 23 is a perspective view showing an ink bottle according to a second embodiment.

FIG. 23 is a perspective view showing an ink bottle according to the present embodiment.

As shown in FIG. 23, an ink bottle 62*f* includes an ink outlet forming portion 65*f*, and has a form in which all of the protrusions 200 of the first erroneous insertion prevention portion 120A and the second erroneous insertion prevention portion 120B of the ink outlet forming portion 65*f* are removed. That is, the first erroneous insertion prevention portion 120A and the second erroneous insertion prevention portion 120B only include the positioning portions 121A and 121B and the base portions 127.

Next, a method for manufacturing the ink bottle 62*f* will be described. First, an ink outlet forming portion 65' including the first erroneous insertion prevention portion 120A and the second erroneous insertion prevention portion 120B is integrally molded (FIG. 17). Then, all of the predetermined protrusions 200 formed on the first and second erroneous insertion prevention portions 120A and 120B are removed.

Also, the ink outlet forming portion 65*f* from which all of the protruding portions 200 have been removed, the seal member 68, and the container main body portion 67 are combined. Accordingly, the ink bottle 62*f* is formed.

Note that the first erroneous insertion prevention portion 120A and the second erroneous insertion prevention portion 120B of the present embodiment are also point-symmetrical with respect to the center of the ink outlet 95. Also, the ink bottle 62*f* can be inserted into the slot portions 54.

Also, as another method for manufacturing the ink bottle 62*f*, instead of forming the ink outlet forming portion 65*f* by removing all of the protrusions 200 after the ink outlet forming portion 65' including the first erroneous insertion prevention portion 120A and the second erroneous insertion prevention portion 120B is formed integrally, it is also possible to remove the protrusions 200 in a state in which the ink bottle 62 includes an already-manufactured ink outlet forming portion 65 (e.g., the ink bottles 62*a* to 62*e* including the ink outlet forming portions 65*a* to 65*e* of the first embodiment).

Note that when the predetermined protrusions 200 are removed from the ink outlet forming portion 65' shown in FIG. 17, traces resulting from the protrusions 200 being removed can be viewed by eyesight or a stereoscopic microscope (at about 2 to 10-fold magnification) on the side surfaces of the base portions 127. Examples of the traces on the side surfaces of the base portions 127 include linear traces of the notches 201 and fracture traces (recesses and protrusions, etc.) resulting from the protrusions 200 being removed.

According to the present embodiment described above, the following effects can be obtained.

Since the ink bottle 62*f* is compatible with the slot portions 54, an ink bottle 62*f* of one form can be used in common therefor.

Also, the ink bottle 62*f* with no protrusions 200 and another ink bottle 62 having protrusions 200 can be used as appropriate to increase the convenience for the user.

Third Embodiment

Next, a third embodiment will be described.

In the first embodiment, a mode was used in which the first erroneous insertion prevention portion 120A and the second erroneous insertion prevention portion 120B in the ink bottles 62 correspond to the slot portions 54, but in the present embodiment, a configuration of an ink bottle that is compatible with another ink tank as well as being used in common for all of the slot portions 54 will be described.

Note that the basic configurations of the ink ejection system, the bottle set, and the like are similar to those of the first embodiment, and therefore description thereof is omitted.

Figure 24:
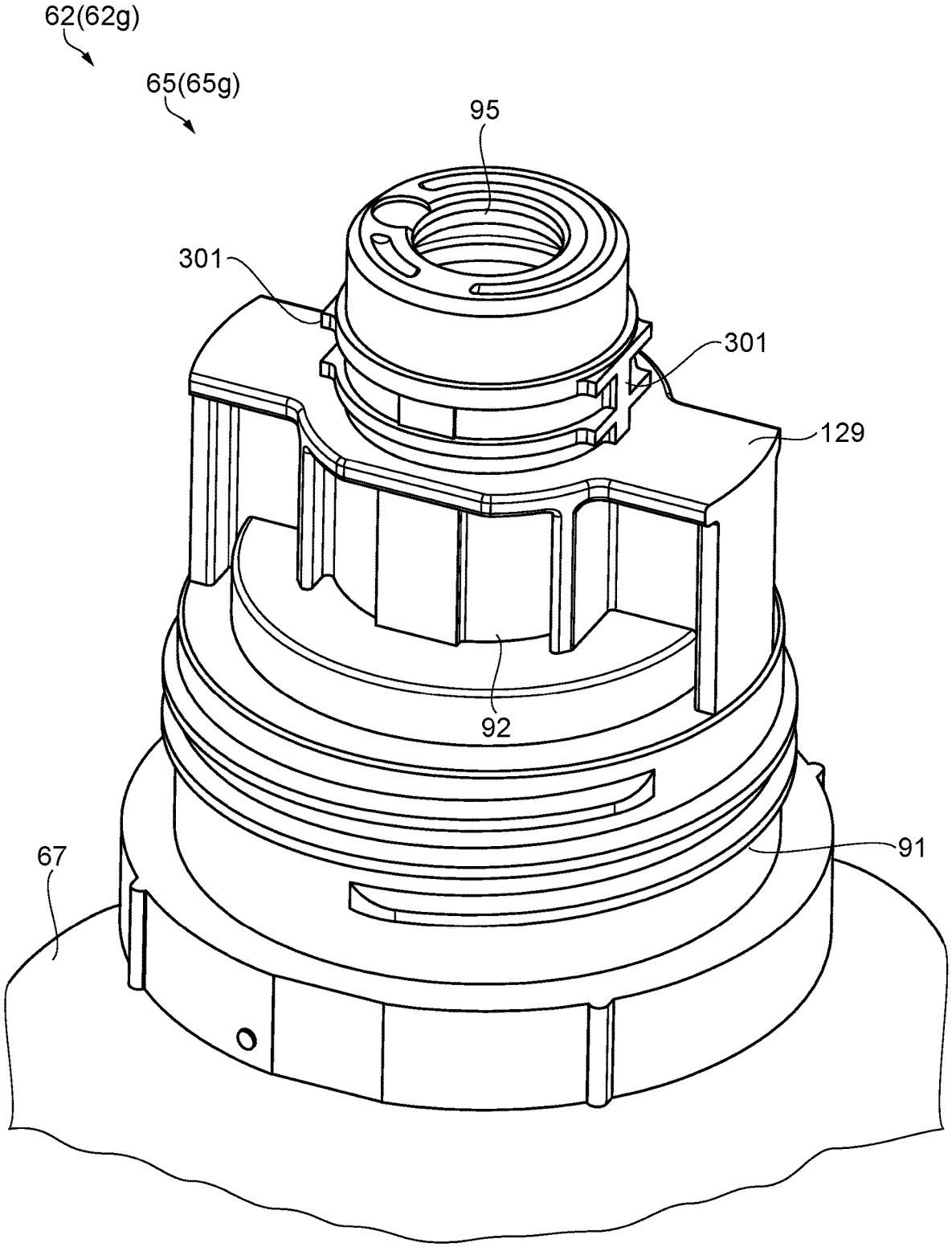
FIG. 24 is a perspective view showing an ink bottle according to a third embodiment.

FIG. 24 is a perspective view showing an ink bottle according to the present embodiment.

As shown in FIG. 24, an ink bottle 62*g* includes an ink outlet forming portion 65*g*, and the first erroneous insertion prevention portion 120A and the second erroneous insertion prevention portion 120B in the ink outlet forming portion 65*g* are removed.

Specifically, the ink outlet forming portion 65*g* includes a first support surface 129 that is provided at an intermediate position between the coupling portion 91 of the tube portion 92 and the end surface 94, and the first erroneous insertion prevention portion 120A and the second erroneous insertion prevention portion 120B in the end surface 94 direction have been removed from the first support surface 129.

Also, a protruding portion 301 is formed above the first support surface 129. In the present embodiment, a protruding portion 301 is formed on the side surface portion of the tube portion 92. The protruding portion 301 is a trace that is formed after the first erroneous insertion prevention portion 120A and the second erroneous insertion prevention portion 120B are removed.

Note that the protruding portion 301 can be viewed by eyesight or a stereoscopic microscope (at about 2 to 10-fold magnification). Also, other than the case in which the surface portion of the protruding portion 301 is flat, a case is also possible in which it is an uneven surface.

Also, due to the removal of the first erroneous insertion prevention portion 120A and the second erroneous insertion prevention portion 120B, the leading end portion of the ink outlet forming portion 65*g* is only cylindrical.

Next, a method for manufacturing the ink bottle 62*g* will be described.

First, an ink outlet forming portion 65' including the first erroneous insertion prevention portion 120A and the second erroneous insertion prevention portion 120B is integrally molded (FIG. 17). Then, the first erroneous insertion prevention portion 120A and the second erroneous insertion prevention portion 120B in the end surface 94 direction from the first support surface 129 are removed. As a method for removing the first erroneous insertion prevention portion 120A and the second erroneous insertion prevention portion 120B, a tool such as a cutter or a nipper, a dedicated cutting jig, or the like is used.

Then, the ink outlet forming portion 65*g* from which the first erroneous insertion prevention portion 120A and the second erroneous insertion prevention portion 120B have been removed, the seal member 68, and the container main body portion 67 are combined. Accordingly, the ink bottle 62*g* is formed.

Also, as another method for manufacturing the ink bottle 62*g*, it is possible to remove the first erroneous insertion prevention portion 120A and the second erroneous insertion prevention portion 120B in a state in which the ink bottle 62 has an already-manufactured ink outlet forming portion 65 (e.g., the ink bottles 62*a* to 62*e* having the ink outlet forming portions 65*a* to 65*e* in the first embodiment).

Figure 25:
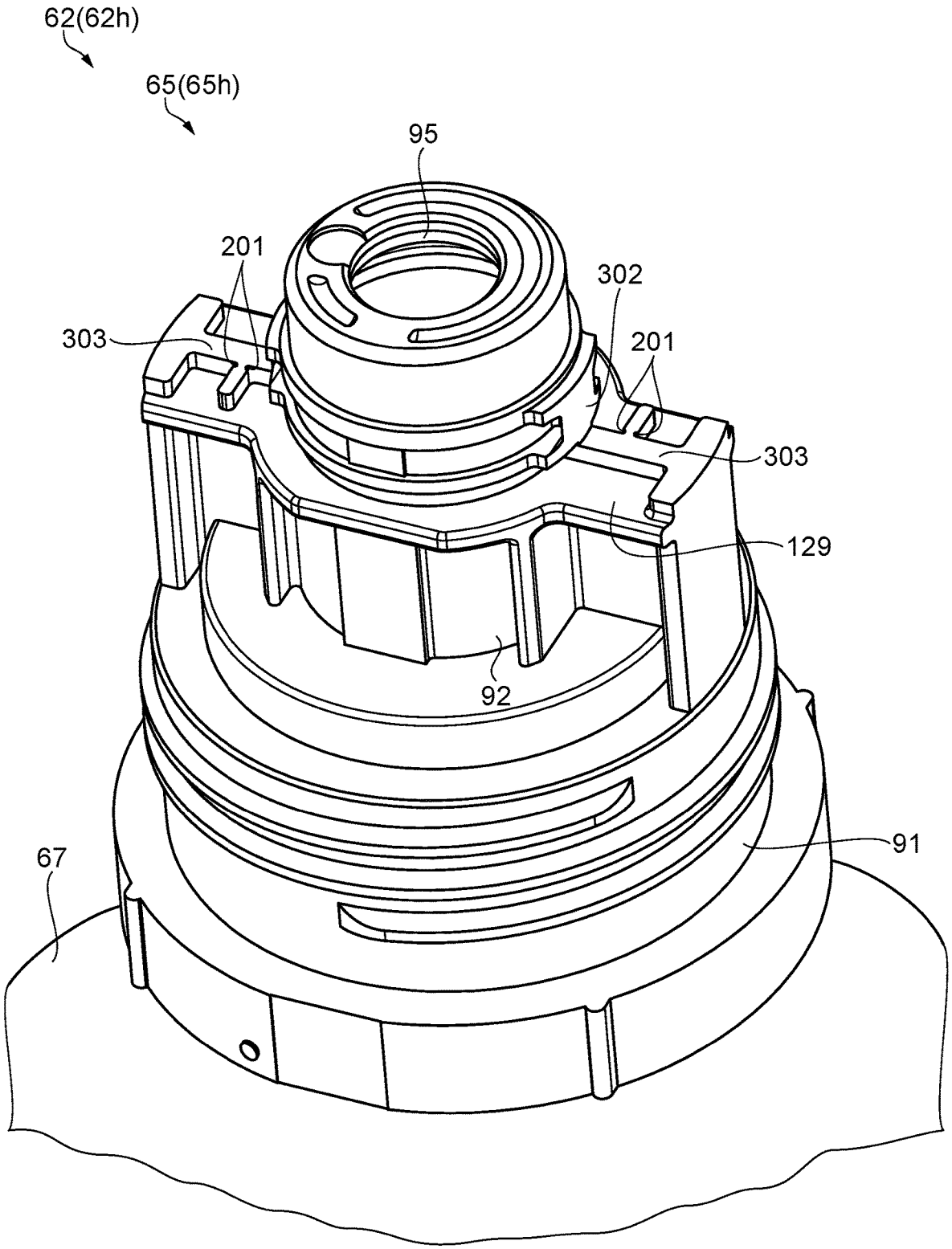
FIG. 25 is a perspective view showing another ink bottle according to the third embodiment.

FIG. 25 is a perspective view showing another ink bottle according to the present embodiment.

As shown in FIG. 25, an ink bottle 62*h* includes an ink outlet forming portion 65*h*, and the first erroneous insertion prevention portion 120A and the second erroneous insertion prevention portion 120B in the ink outlet forming portion 65*h* are removed.

Specifically, the ink outlet forming portion 65*h* includes a first support surface 129 that is provided at an intermediate position between the coupling portion 91 of the tube portion 92 and the end surface 94 and supports the base portion 127, and the first erroneous insertion prevention portion 120A and the second erroneous insertion prevention portion 120B in the end surface 94 direction have been removed from the first support surface 129.

Also, a protruding portion 302 and a protruding portion 303 are formed above the first support surface 129. In the present embodiment, the protruding portion 302 is formed on the side surface portion of the tube portion 92. Furthermore, the protruding portion 303 is formed on the first support surface 129. These protruding portions 302 and 303 are traces that are formed when the first erroneous insertion prevention portion 120A and the second erroneous insertion prevention portion 120B are removed.

Note that the protruding portions 302 and 303 can be viewed by eyesight or a stereoscopic microscope (at about 2 to 10-fold magnification). Also, other than the case in which the surface portion of the protruding portions 302 and 303 is a flat surface, a case is also possible in which they are uneven surfaces.

Also, due to the removal of the first erroneous insertion prevention portion 120A and the second erroneous insertion prevention portion 120B, the leading end portion of the ink outlet forming portion 65*h* is only cylindrical.

As the method for manufacturing the ink bottle 62*h*, the first erroneous insertion prevention portion 120A and the second erroneous insertion prevention portion 120B are removed in a state in which the ink bottle 62 includes an already-manufactured ink outlet forming portion 65 (e.g., the ink bottles 62*a* to 62*e* including the ink outlet forming portions 65*a* to 65*e* of the first embodiment). Accordingly, a portion of the protrusions 200 and the notches 201 remain as traces on the protruding portion 303.

As a method for removing the first erroneous insertion prevention portion 120A and the second erroneous insertion prevention portion 120B, a tool such as a cutter or a nipper, a dedicated cutting jig, or the like is used.

Then, the ink outlet forming portion 65*h* from which the first erroneous insertion prevention portion 120A and the second erroneous insertion prevention portion 120B have been removed, the seal member 68, and the container main body portion 67 are combined. Accordingly, the ink bottle 62*h* is formed.

As another method for manufacturing the ink bottle 62*h*, the ink outlet forming portion 65' including the first erroneous insertion prevention portion 120A and the second erroneous insertion prevention portion 120B is molded integrally (FIG. 17). Then, the first erroneous insertion prevention portion 120A and the second erroneous insertion prevention portion 1206 in the end surface 94 direction from the first support surface 129 may be removed.

Figure 26:
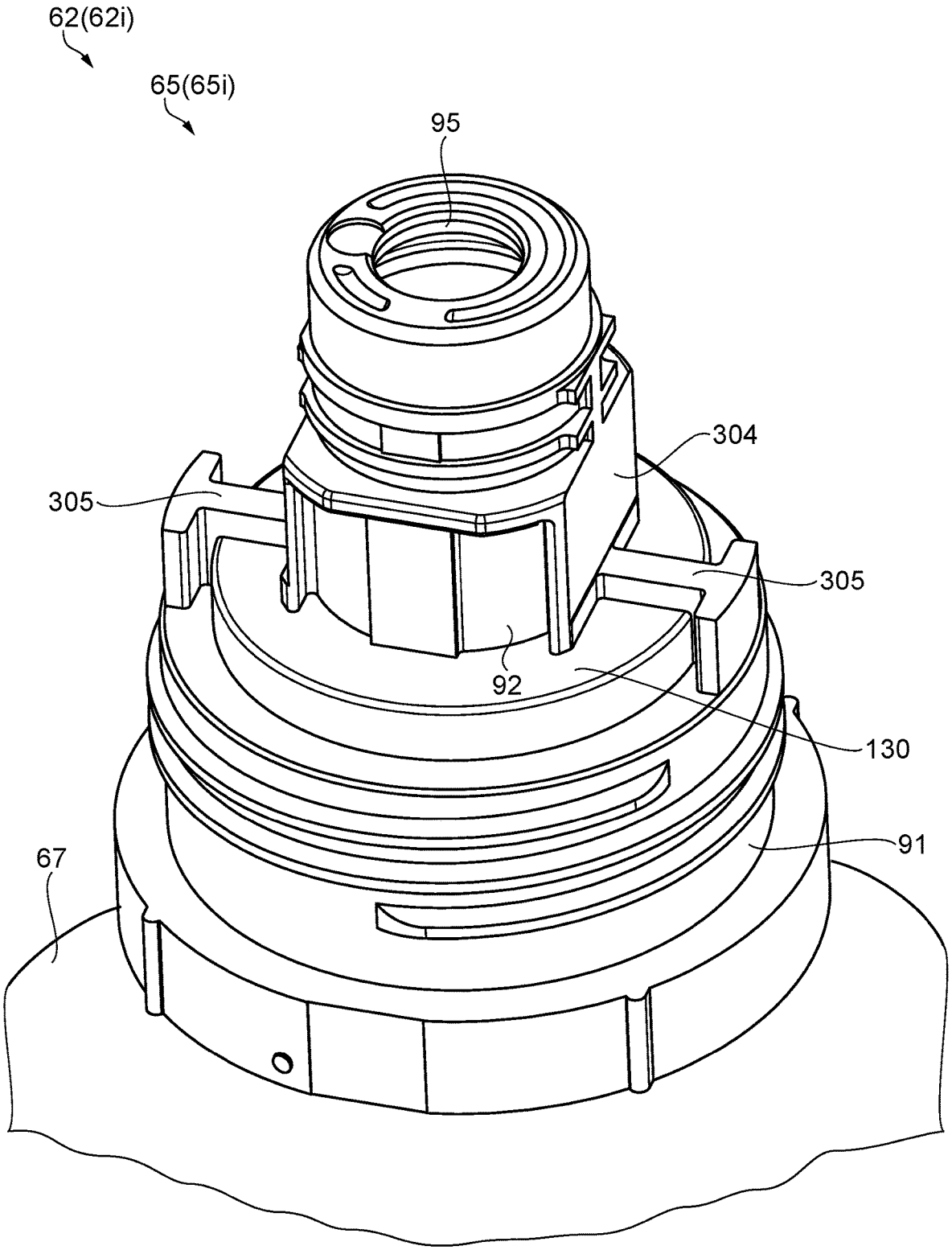
FIG. 26 is a perspective view showing another ink bottle according to the third embodiment.

FIG. 26 is a perspective view showing another ink bottle according to the present embodiment.

As shown in FIG. 26, an ink bottle 62*i* includes an ink outlet forming portion 65*i*, and the first erroneous insertion prevention portion 120A and the second erroneous insertion prevention portion 120B in the ink outlet forming portion 65*i* are removed.

Specifically, the ink outlet forming portion 65*i* includes a second support surface at a portion in contact with the boundary between the tube portion 92 and the coupling portion 91, and the first erroneous insertion prevention portion 120A and the second erroneous insertion prevention portion 120B in the end surface 94 direction from the second support surface 130 are removed.

Also, a protruding portion 304 and a protruding portion 305 are formed above the second support surface 130. In the present embodiment, the protruding portion 304 is formed on the side surface portion of the tube portion 92. Furthermore, the protruding portion 305 is formed on the second support surface 130. These protruding portions 304 and 305 are traces that are formed when the first erroneous insertion prevention portion 120A and the second erroneous insertion prevention portion 120B are removed.

Note that the protruding portions 304 and 305 can be viewed by eyesight or a stereoscopic microscope (at about 2 to 10-fold magnification). Also, other than the case in which the surface portion of the protruding portions 304 and 305 is a flat surface, a case is also possible in which they are uneven surfaces.

Also, due to the removal of the first erroneous insertion prevention portion 120A and the second erroneous insertion prevention portion 120B, the leading end portion of the ink outlet forming portion 65*i* is only cylindrical.

As the method for manufacturing the ink bottle 62*i*, first, the ink outlet forming portion 65' including the first erroneous insertion prevention portion 120A and the second erroneous insertion prevention portion 120B is molded integrally (FIG. 17). Then, the first erroneous insertion prevention portion 120A and the second erroneous insertion prevention portion 1206 in the end surface 94 direction from the first support surface 130 are removed. As a method for removing the first erroneous insertion prevention portion 120A and the second erroneous insertion prevention portion 120B, a tool such as a cutter or a nipper, a dedicated cutting jig, or the like is used.

Then, the ink outlet forming portion 65*i* from which the first erroneous insertion prevention portion 120A and the second erroneous insertion prevention portion 120B have been removed, the seal member 68, and the container main body portion 67 are combined. Accordingly, the ink bottle 62*i* is formed.

Also, as another method for manufacturing the ink bottle 62*i*, it is possible to remove the first erroneous insertion prevention portion 120A and the second erroneous insertion prevention portion 120B in a state in which the ink bottle 62 has an already-manufactured ink outlet forming portion 65 (e.g., the ink bottles 62*a* to 62*e* having the ink outlet forming portions 65*a* to 65*e* in the first embodiment).

According to the present embodiment described above, the following effects can be obtained.

Since the ink bottle 62*i* is compatible with the slot portions 54, an ink bottle 62*f* of one form can be used in common therefor.

Also, the ink bottle 62*i* with no protrusions 200 and another ink bottle 62 having protrusions 200 can be used as appropriate to increase the convenience for the user.

Furthermore, the ink bottle 62*i* can be used also in an ink supply apparatus of another different ink ejection system, and furthermore, the convenience for the user can be increased.

Fourth Embodiment

Next, a fourth embodiment will be described.

In the first embodiment, the ink outlet forming portion 65 was molded integrally, but in the present embodiment, a configuration in which the ink forming portion 65 is formed using multiple members will be described.

Note that the basic configurations of the ink ejection system, the bottle set, and the like are similar to those of the first embodiment, and therefore description thereof is omitted.

Figure 27:
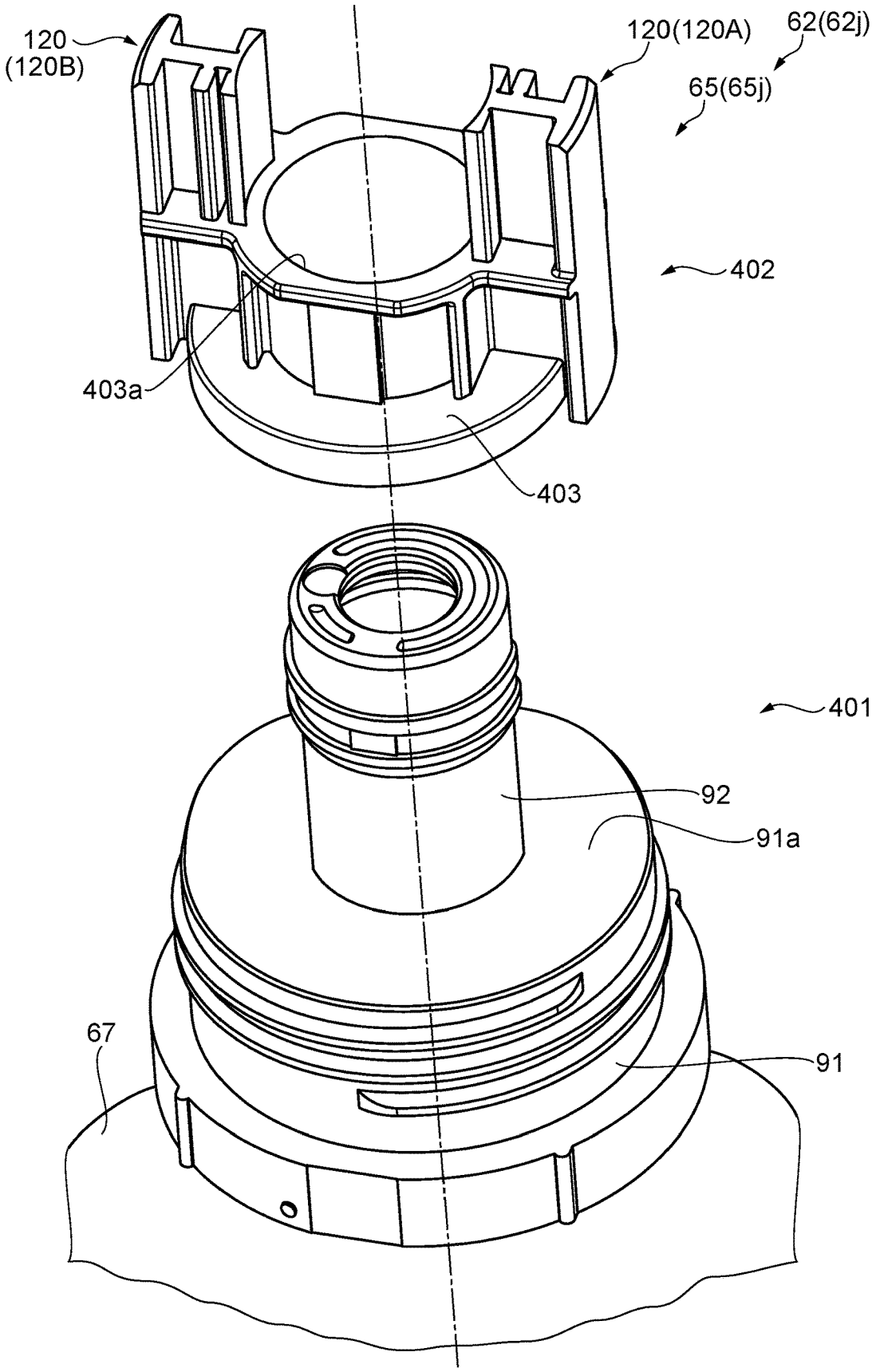
FIG. 27 is an exploded view showing an ink bottle according to a fourth embodiment.

FIG. 27 is an exploded view showing an ink bottle according to the present embodiment.

As shown in FIG. 27, an ink bottle 62*j* includes an ink outlet forming portion 65*j*, and the ink outlet forming portion 65*j* has a first member 401 and a second member 402. The first member 401 and the second member 402 are molded as separate members. Also, the first member 401 and the second member 402 can attach to and detach from each other.

The first member 401 has the coupling portion 91 and the tube portion 92, and the second member 402 includes erroneous insertion prevention portions 120 (first erroneous insertion prevention portion 120A and second erroneous insertion prevention portion 120B). Also, the second member 402 has a through hole 403*a* and includes the support portion 403 that supports the first erroneous insertion prevention portion 120A and the second erroneous insertion prevention portion 120B. The through hole 403*a* is formed to be of a size according to which the tube portion 92 of the first member 401 can be inserted.

Also, the tube portion 92 of the first member 401 is inserted into the through hole 403*a* of the second member 402 and the upper surface 91*a* of the coupling portion 91 and the support portion 403 are coupled. The coupling of the upper surface 91*a* and the support portion 403 may be engagement performed using a screw structure, or may be adhesion performed using adhesive or the like. The ink outlet forming portion 65*j* is formed by coupling the upper surface 91*a* and the support portion 403.

Then, the ink outlet forming portion 65*j*, the seal member 68, and the container main body portion 67 are combined. Accordingly, the ink bottle 62*j* is formed.

Note that in the formation of the ink outlet forming portion 65*j*, the second members 402 corresponding to the slot portions 54 are formed and the user selects a second member 402 as appropriate and combines it with the first member 401.

According to the present embodiment described above, the following effects can be obtained.

By attaching the second member 402 including the first and second erroneous insertion prevention portions 120A and 120B conforming to the shape of the slot portion 54 to the first member 401, the molding apparatus or the like of the first member 401 can be used in common (streamlined), and therefore a reduction in the manufacturing cost of the ink bottle 62*j* can be expected.

Furthermore, depending on whether the second member 402 is attached or detached, it is possible to perform insertion into ink tanks mounted in various types of printers, and thus it is possible to increase versatility.

Accordingly, the number of options for use methods of the ink bottle 62*j* increase for the user, and thus convenience can be improved.

Note that the invention is not limited to the above-described embodiments, and various modifications, improvements, and the like can be added to the above-described embodiments. Modified examples will be described hereinafter.

Modified Example 1

Figure 28:
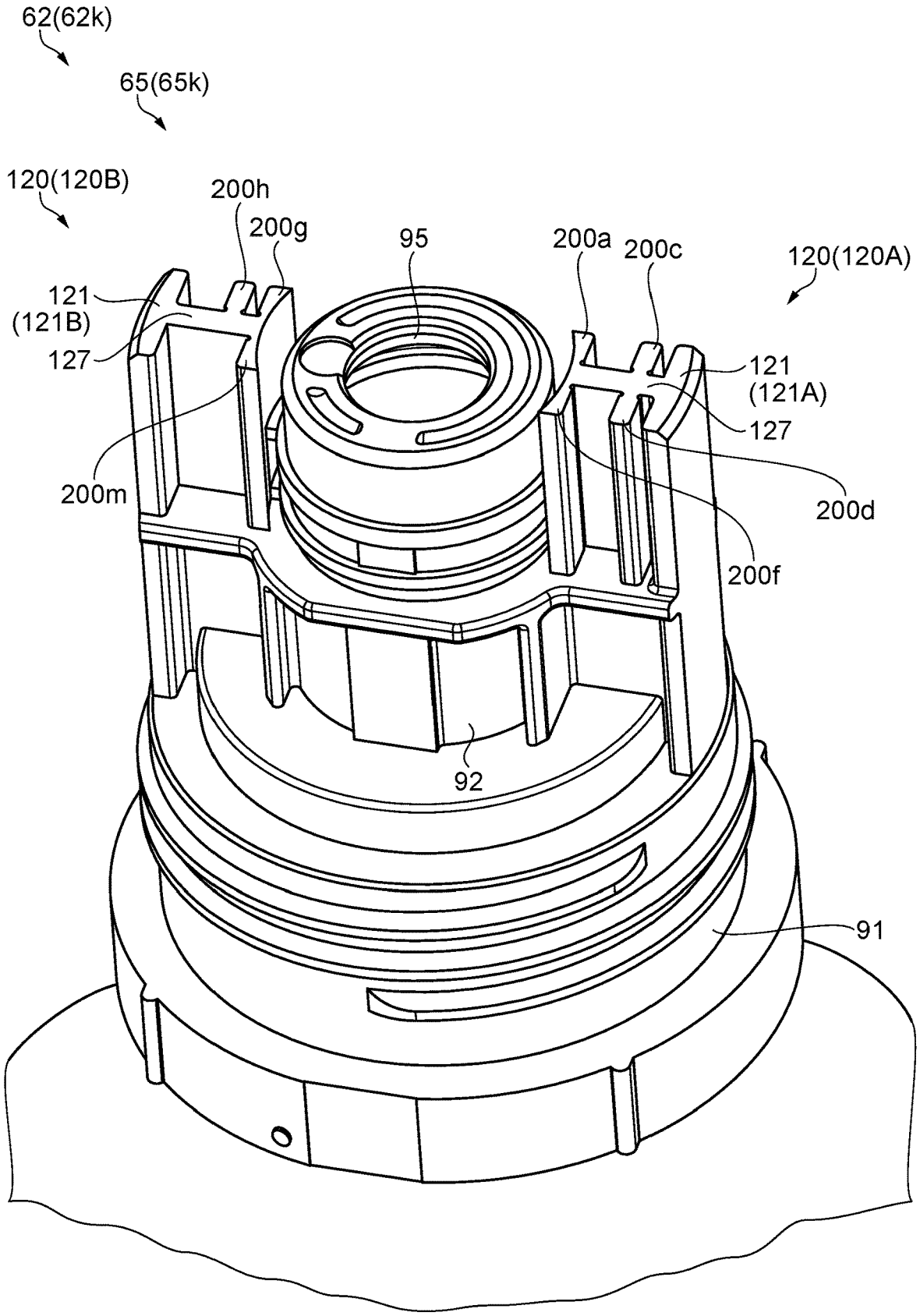
FIG. 28 is a perspective view showing an ink bottle according to Modified Example 1.

In the first embodiment, the positioning portion 121A and the positioning portion 121B were formed so as to be point-symmetrical with respect to the central axis CL of the ink outlet 95, but there is no limitation to this. FIG. 28 is a perspective view showing an ink bottle according to the present modified example.

As shown in FIG. 28, in an ink outlet forming portion 65*k* of an ink bottle 62*k*, the first erroneous insertion prevention portion 120A and the second erroneous insertion prevention portion 120B are formed so as not to be point-symmetrical with respect to the central axis CL of the ink outlet 95. In other words, the protrusions 200 are removed such that the first erroneous insertion prevention portion 120A and the second erroneous insertion prevention portion 120B are not point-symmetrical with respect to the central axis CL of the ink outlet 95. By doing so, it is possible to further increase the number of patterns for erroneous insertion prevention.

Modified Example 2

In the first embodiment, a configuration was described in which the protrusions 200 are removed in the first erroneous insertion prevention portion 120A and the second erroneous insertion prevention portion 120B, but there is no limitation to this. For example, the protrusions 200 that were removed from the first erroneous insertion prevention portion 120A and the second erroneous insertion prevention portion 120B may be attached once again to the base portion 127. In this case, the protrusions 200 are adhered to the base portion 127 using adhesive. By doing so, it is possible to reuse the protrusions 200 and the manufacturing cost of the ink bottle 62 can be suppressed.

Modified Example 3

In the above embodiments, the ink ejection apparatus may be a liquid ejection apparatus that ejects, discharges, or applies liquid other than ink to consume the liquid. Note that the status of liquid discharged as very small droplets from the liquid ejection apparatus includes a granular shape, a tear-drop shape, and a shape having a thread-like trailing end. Furthermore, the liquid mentioned here may be any kind of material that can be consumed by the liquid ejection apparatus. For example, the liquid need only be a material whose substance is in the liquid phase, and includes fluids such as inorganic solvent, organic solvent, solution, liquid resin, and liquid metal (metal melt) in the form of a liquid body having a high or low viscosity, sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiment, as well as liquid crystal, and the like. Here, "ink" encompasses general water-based ink and oil-based ink, as well as various types of liquid compositions such as gel ink and hot melt-ink. Specific examples of the liquid ejection apparatus include liquid ejection apparatuses that eject a liquid containing, in the form of dispersion or dissolution, a material such as an electrode material or a color material used in manufacturing or the like of a liquid crystal display, an EL (electroluminescence) display, a surface-emitting display, or a color filter, for example. The liquid ejection apparatus may also be a liquid ejection apparatus that ejects biological organic matter used in manufacturing of a biochip, a liquid ejection apparatus that is used as a precision pipette and ejects a liquid serving as a sample, a textile printing apparatus, a microdispenser, or the like. Furthermore, the liquid ejection apparatus may also be a liquid ejection apparatus that ejects lubricating oil in a pinpoint manner to a precision machine such as a watch or a camera, or a liquid ejection apparatus that ejects a transparent resin liquid such as ultraviolet-cured resin onto a substrate in order to form a micro-hemispherical lens (optical lens) or the like that is used in an optical communication device or the like. Furthermore, the liquid ejection apparatus may be a liquid ejection apparatus that ejects an etchant which is acid, alkaline, or the like, in order to etch a substrate or the like.

Note that the invention is not limited to the above embodiments, and can be achieved by various configurations without departing from the gist thereof. For example, the technical features in the embodiment and examples that correspond to the technical features in the modes described in the summary of the invention may be replaced or combined as appropriate in order to solve part of or the entire foregoing problem, or to achieve some or all of the above-described effects. The technical features that are not described as essential in the specification can be deleted as appropriate.

In the above embodiment, the ink bottle is made of an elastic material, but the entirety or a portion of the ink bottle may be formed of another material such as glass, ceramic, or metal.

The present application is based on, and claim priority from JP Application Serial Number 2017-150476, filed Aug. 3, 2017.

What is claimed is:

1. An ink replenishment container for replenishing ink in an ink tank comprising an ink storage chamber with an interior in which the ink can be stored, an ink inlet through which the ink can flow into the interior of the ink storage chamber, and a recessed portion positioned around a periphery of the ink inlet, the ink replenishment container comprising:

a container main body portion configured to contain the ink; and an ink outlet forming portion that is to be attached to an end portion of the container main body portion and at which an ink outlet through which the ink in the container main body portion flows out is formed, wherein, in a region located outside of the ink outlet in a radial direction centered about the ink outlet, the ink outlet forming portion comprises an erroneous insertion prevention portion that protrudes in a direction opposite to the container main body portion in an axial direction taking the center of the ink outlet as an axis, and that is configured to be inserted into the recessed portion, wherein the erroneous insertion prevention portion comprises a base portion, and a plurality of removable protrusions disposed on the base portion and configured to be removed from the base portion in accordance with a shape of the recessed portion to allow the erroneous insertion prevention portion to be inserted in the recessed portion.

2. The ink replenishment container according to claim 1, wherein a plurality of erroneous insertion prevention portions that includes the erroneous insertion prevention portion are formed.

3. The ink replenishment container according to claim 1, wherein notches are provided on end portions of the plurality of removable protrusions that are on a base portion side of the plurality of removable protrusions to permit the plurality of removable protrusions to be removed from the base portion.

4. The ink replenishment container of claim 3, wherein the end portions of the plurality of removable protrusions face toward the base portion of the erroneous insertion prevention portion.

5. The ink replenishment container according to claim 1, wherein the erroneous insertion prevention portion comprises a first erroneous insertion prevention portion and a second erroneous insertion prevention portion that oppose each other via the ink outlet, and the plurality of removable protrusions on the first erroneous insertion prevention portion and the plurality of removable protrusions on the second erroneous insertion prevention portion are removed so as to be point-symmetrical with respect to the center of the ink outlet.

6. The ink replenishment container of claim 1, wherein the base portion extends radially out from a periphery of the ink outlet.

7. The ink replenishment container of claim 6, wherein the plurality of removable protrusions extend substantially perpendicularly from the base portion.

8. An ink replenishment container for replenishing ink in an ink tank comprising an ink storage chamber with an interior in which the ink can be stored, an ink inlet through which the ink can flow into the interior of the ink storage chamber, and a recessed portion positioned around a periphery of the ink inlet, the ink replenishment container comprising:

a container main body portion configured to contain the ink; and an ink outlet forming portion that is to be attached to the container main body portion and at which an ink outlet through which the ink in the container main body portion flows out is formed, wherein the ink outlet forming portion comprises:

a first member that comprises:

a coupling portion configured to be coupled to the container main body portion, and a tube portion comprising the ink outlet, and a second member that is configured to be attached to or detached from the first member and comprises:

an erroneous insertion prevention portion configured to be inserted into the recessed portion, wherein at least a portion of the erroneous insertion prevention portion is detachable from the first member by detaching the second member from the first member, and a through hole through which the tube portion is passed when the second member is attached to or detached from the first member.

9. A method for manufacturing an ink replenishment container for replenishing ink in an ink tank comprising an ink storage chamber with an interior in which the ink can be stored, an ink inlet through which the ink can flow into the interior of the ink storage chamber, and a recessed portion positioned around a periphery of the ink inlet, the method comprising:

providing the ink replenishment container comprising:

a container main body portion configured to contain the ink, and an ink outlet forming portion that is to be attached to an end portion of the container main body portion and at which an ink outlet through which the ink of the container main body portion flows out is formed, wherein the ink outlet forming portion comprises an erroneous insertion prevention portion configured to be inserted into the recessed portion; and removing at least a portion of the erroneous insertion prevention portion from a portion of the ink outlet forming portion.

10. The method for manufacturing an ink replenishment container according to claim 9, wherein the erroneous insertion prevention portion of the ink outlet forming portion comprises a first erroneous insertion prevention portion and a second erroneous insertion prevention portion, wherein the step of removing at least a portion of the erroneous insertion prevention portion comprises removing the first erroneous insertion prevention portion or the second erroneous insertion prevention portion.

11. The method for manufacturing an ink replenishment container according to claim 9, wherein the erroneous insertion prevention portion comprises a base portion and a plurality of removable protrusions disposed on the base portion, wherein the step of removing at least a portion of the erroneous insertion prevention portion comprises removing a predetermined protrusion of the plurality of removable protrusions.

12. The method for manufacturing an ink replenishment container according to claim 11, wherein notches are provided on end portions of the plurality of removable protrusions that are on a base portion side of the plurality of removable protrusions, wherein the step of removing at least a portion of the erroneous insertion prevention portion comprises removing at least one of the plurality of removable protrusions from the base portion along at least one of the notches.

13. The method for manufacturing an ink replenishment container according to claim 11, wherein the erroneous insertion prevention portion comprises a first erroneous insertion prevention portion and a second erroneous insertion prevention portion that are arranged so as to oppose each other via the ink outlet, and the first erroneous insertion prevention portion and the second erroneous insertion prevention portion are formed so as to be point-symmetrical with respect to the center of the ink outlet.

14. The method for manufacturing an ink replenishment container according to claim 13, wherein the step of removing at least a portion of the erroneous insertion prevention portion comprises removing the predetermined protrusions such that the first erroneous insertion prevention portion and the second erroneous insertion prevention portion are point-symmetrical with respect to the center of the ink outlet.

15. The method for manufacturing an ink replenishment container according to claim 13, wherein the step of removing at least a portion of the erroneous insertion prevention portion comprises removing all of the plurality of removable protrusions formed on the first erroneous insertion prevention portion and the second erroneous insertion prevention portion.

16. The method for manufacturing an ink replenishment container according to claim 13, wherein the step of removing at least a portion of the erroneous insertion prevention portion comprises removing the predetermined protrusions such that the first erroneous insertion prevention portion and the second erroneous insertion prevention portion are not point-symmetrical with respect to the center of the ink outlet.

17. The method for manufacturing an ink replenishment container according to claim 9, further comprising inserting the erroneous insertion prevention portion into the recessed portion with at least a portion of the erroneous insertion prevention portion removed in accordance with a shape of the recessed portion to allow the erroneous insertion prevention portion to be inserted in the recessed portion.

18. The method for manufacturing an ink replenishment container according to claim 9, wherein the ink outlet forming portion comprises:

a first member that comprises:

a coupling portion configured to be coupled to the container main body portion, and a tube portion comprising the ink outlet, and a second member that is configured to be attached to or detached from the first member and comprises:

the erroneous insertion prevention portion, wherein at least a portion of the erroneous insertion prevention portion is detachable from the first member by detaching the second member from the first member, and a through hole through which the tube portion is passed when the second member is attached to or detached from the first member, and wherein the step of removing at least a portion of the erroneous insertion prevention portion comprises detaching the second member from the first member.

* * * * *